US012110889B2

(12) United States Patent
Chiba et al.

(10) Patent No.: US 12,110,889 B2
(45) Date of Patent: Oct. 8, 2024

(54) SCREW COMPRESSOR

(71) Applicant: Hitachi Industrial Equipment Systems Co., Ltd., Tokyo (JP)

(72) Inventors: Kotaro Chiba, Tokyo (JP); Masahiko Takano, Tokyo (JP); Shigeyuki Yorikane, Tokyo (JP); Kenji Morita, Tokyo (JP); Yuta Kajie, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 18/267,289

(22) PCT Filed: Nov. 12, 2021

(86) PCT No.: PCT/JP2021/041804
§ 371 (c)(1),
(2) Date: Jun. 14, 2023

(87) PCT Pub. No.: WO2022/130861
PCT Pub. Date: Jun. 23, 2022

(65) Prior Publication Data

US 2024/0052830 A1 Feb. 15, 2024

(30) Foreign Application Priority Data

Dec. 18, 2020 (JP) ..... 2020-209862

(51) Int. Cl.
*F04C 18/16* (2006.01)
*F04C 2/16* (2006.01)
*F04C 27/00* (2006.01)

(52) U.S. Cl.
CPC ..... *F04C 18/16* (2013.01); *F04C 2/16* (2013.01); *F04C 27/005* (2013.01); *F04C 2240/20* (2013.01); *F04C 2240/30* (2013.01)

(58) Field of Classification Search
CPC ..... F04C 18/16; F04C 18/165; F04C 18/084; F04C 18/088; F04C 2/16; F04C 2/084;
(Continued)

(56) References Cited

U.S. PATENT DOCUMENTS

2012/0134863 A1* 5/2012 Collie ..... F04C 27/005 418/55.1

FOREIGN PATENT DOCUMENTS

| | | | | |
|---|---|---|---|---|
| JP | 49-118811 U | | 10/1974 | |
| JP | 59-176487 A | | 10/1984 | |
| JP | 63-36083 A | | 2/1988 | |
| JP | 2003278673 A | * | 10/2003 | ..... F04C 18/16 |
| JP | 2006-226160 A | | 8/2006 | |
| WO | WO-2023243171 A1 | * | 12/2023 | |

OTHER PUBLICATIONS

International Search Report (PCT/ISA/210) issued in PCT Application No. PCT/JP2021/041804 dated Dec. 14, 2021 with English translation (four (4) pages).
(Continued)

*Primary Examiner* — Mark A Laurenzi
*Assistant Examiner* — Xiaoting Hui
(74) *Attorney, Agent, or Firm* — Crowell & Moring LLP

(57) ABSTRACT

A casing of a screw compressor has a delivery inner wall face facing delivery end faces of a male rotor and a female rotor. The delivery inner wall face of the casing has a shield area that shields at least a part of a track of an axial fluid communication path, which is a clearance that periodically occurs at the delivery end faces according to variation of intermeshing of the male and female rotors upon rotation thereof and is bounded by trailing flanks of the male and female rotors. The shield area of the casing is provided with a groove group made up of a plurality of grooves having longitudinal directions. The grooves of the groove group are juxtaposed in the circumferential direction of at least one rotor of the male and female rotors and are arranged such that their sides extending in the longitudinal directions are
(Continued)

disposed adjacent to each other. Each groove of the groove group is configured such that its longitudinal direction oriented from the inner circumferential side of the one rotor toward the outer circumferential side is inclined with respect to the radial direction of the one rotor in the same direction as the rotational direction of the one rotor.

16 Claims, 22 Drawing Sheets

(58) Field of Classification Search
CPC .... F04C 2/088; F04C 27/005; F04C 2240/20; F04C 2240/30
See application file for complete search history.

(56) References Cited

OTHER PUBLICATIONS

Japanese-language Written Opinion (PCT/ISA/237) issued in PCT Application No. PCT/JP2021/041804 dated Dec. 14, 2021 (four (4) pages).
International Preliminary Report on Patentability (PCT/IB/338 & PCT/IB/373) issued in PCT Application No. PCT/JP2021/041804 dated Jun. 29, 2023, Including English translation (Japanese-language Written Opinion (PCT/ISA/237), filed on Jun. 14, 2023) (7 pages).

* cited by examiner

SCREW COMPRESSOR

TECHNICAL FIELD

The present invention relates to a screw compressor and more particularly to a screw compressor whose working chamber is supplied with a liquid from outside the compressor.

BACKGROUND ART

One representative factor behind a reduction in the performance of screw compressors is an internal leak of compressed gas. The internal leak of compressed gas refers to a phenomenon in which a compressed gas flows back from a high pressure space where a pressure buildup has been caused by the compression of the gas in progress into a relatively low pressure space where the gas has not been compressed yet or the compression of the gas has not been in progress. The internal leak causes an energy loss as the gas that has been compressed by energy reverts to a low-pressure state.

There has been known a technology disclosed in Patent Document 1 as an example of means for reducing an internal leak of compressed gas. Patent Document 1 discloses an oil-cooled screw compressor having a labyrinth of grooves provided, on the delivery end wall of a rotor chamber, between the rotor shafts of a pair of screw rotors. The grooves have lengthwise directions represented by the direction between the rotor shafts.

PRIOR ART DOCUMENT

Patent Document

Patent Document 1: JP-2006-226160-A

SUMMARY OF THE INVENTION

Problems to be Solved by the Invention

According to the technology disclosed in Patent Document 1, of a clearance (hereinafter referred to as "delivery-end-face clearance") formed between the delivery end faces of the screw rotors and the delivery end wall of the rotor chamber, a portion that is positioned between a compressive space in a highest-pressure delivery process and a lowest-pressure compressive space adjacent to the highest-pressure compressive space are sealed. However, a plurality of internal clearances acting as routes for the internal leak of compressed gas exist in addition to the above-mentioned portion of the delivery-end-face clearance. The technology disclosed in Patent Document 1 does not take into account how to reduce an internal leak of compressed gas via internal clearances other than the above portion of the delivery-end-face clearance, and remains to be improved as to the reduction of an internal leak.

An example of internal clearances includes a clearance referred to as an axial fluid communication path. The axial fluid communication path is a clearance that periodically occurs at the delivery end faces as the intermeshing of the male and female rotors varies upon rotation thereof, and is a crescent-shaped opening that is held between the trailing flanks of the rotors to open only in the axial direction. Since a working chamber in a suction process that represents a relatively low pressure space and a delivery fluid passage (delivery space) that represents a relatively high pressure space are held in fluid communication with each other through the axial fluid communication path, the axial fluid communication path is a factor that causes the compressed gas to flow back. Since the route for the internal leak through the axial fluid communication path develops a particularly large pressure difference between the high pressure space as a leakage origin and the low pressure space as a leakage destination among a plurality of internal leak routes that exist on the delivery end face, the route tends to cause a large amount of leakage. The internal leak through the axial fluid communication path is a common problem in liquid-free screw compressors that are actuated with no liquid supplied to their working chambers and liquid-supplied screw compressors where their working chambers are supplied with a liquid such as oil or the like, as disclosed in Patent Document 1.

The present invention has been made in an attempt to solve the above problem. It is an object of the present invention to provide a screw compressor that is capable of reducing an internal leak of compressed gas through an axial fluid communication path.

Means for Solving the Problems

The present application includes a plurality of means for solving the above problems. According to an example of such means, a screw compressor includes a male rotor having a first delivery end face on one side in an axial direction of the male rotor, a female rotor having a second delivery end face on one side in an axial direction of the female rotor, and a casing having a housing chamber in which the male rotor and the female rotor are rotatably housed in a mutually meshed state. The casing has a delivery inner wall face that faces the first delivery end face of the male rotor and the second delivery end face of the female rotor. The delivery inner wall face of the casing has a shield area that shields at least a part of a track of an axial fluid communication path. The axial fluid communication path is a clearance that is periodically generated at the first delivery end face and the second delivery end face according to variation of intermeshing of the male rotor and the female rotor upon rotation thereof and that is bounded by trailing flanks of the male rotor and the female rotor. The shield area of the casing is provided with a groove group comprising a plurality of grooves having longitudinal directions. The plurality of grooves of the groove group are juxtaposed in a circumferential direction of at least one rotor of the male rotor and the female rotor, the plurality of grooves of the groove group are arranged such that their sides extending in the longitudinal directions are disposed adjacent to each other. Each of the plurality of grooves of the groove group is configured such that its longitudinal direction oriented from an inner circumferential side of the one rotor toward an outer circumferential side is inclined with respect to a radial direction of the one rotor in the same direction as a rotational direction of the one rotor.

Advantages of the Invention

According to the example of the present invention, a liquid in the plurality of grooves provided on the delivery inner wall face of the casing is caused to flow in the longitudinal directions by a shear force, and is then dammed, resulting in a pressure buildup. This allows a high-pressure liquid film to be formed in the vicinity of the axial fluid communication path in a delivery-end-face clearance.

Therefore, it is possible to reduce an internal leak of compressed air via the axial fluid communication path.

Problems, structural details, and advantages other than those described above will become apparatus from the description of embodiments below.

MODES FOR CARRYING OUT THE INVENTION

Embodiments of a screw compressor according to the present invention will be described by way of example hereinbelow with reference to the drawings. In the embodiments, the present invention is applied to an oil-flooded screw compressor for compressing air.

First Embodiment

Figure 1:
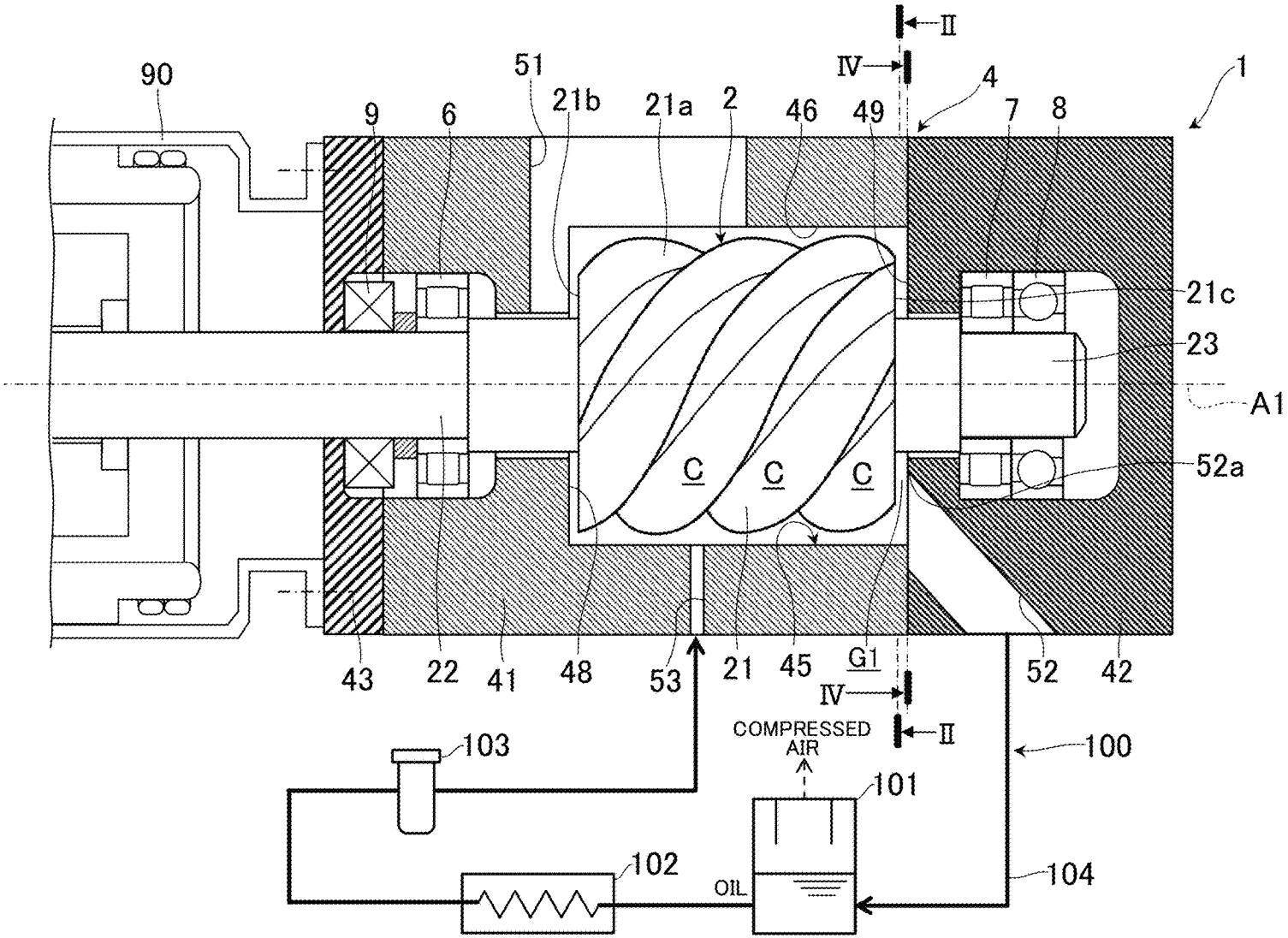
FIG. 1 is a longitudinal cross-sectional view of a screw compressor according to a first embodiment of the present invention and a systematic diagram illustrating an external route for supplying oil to the screw compressor.
Figure 2:
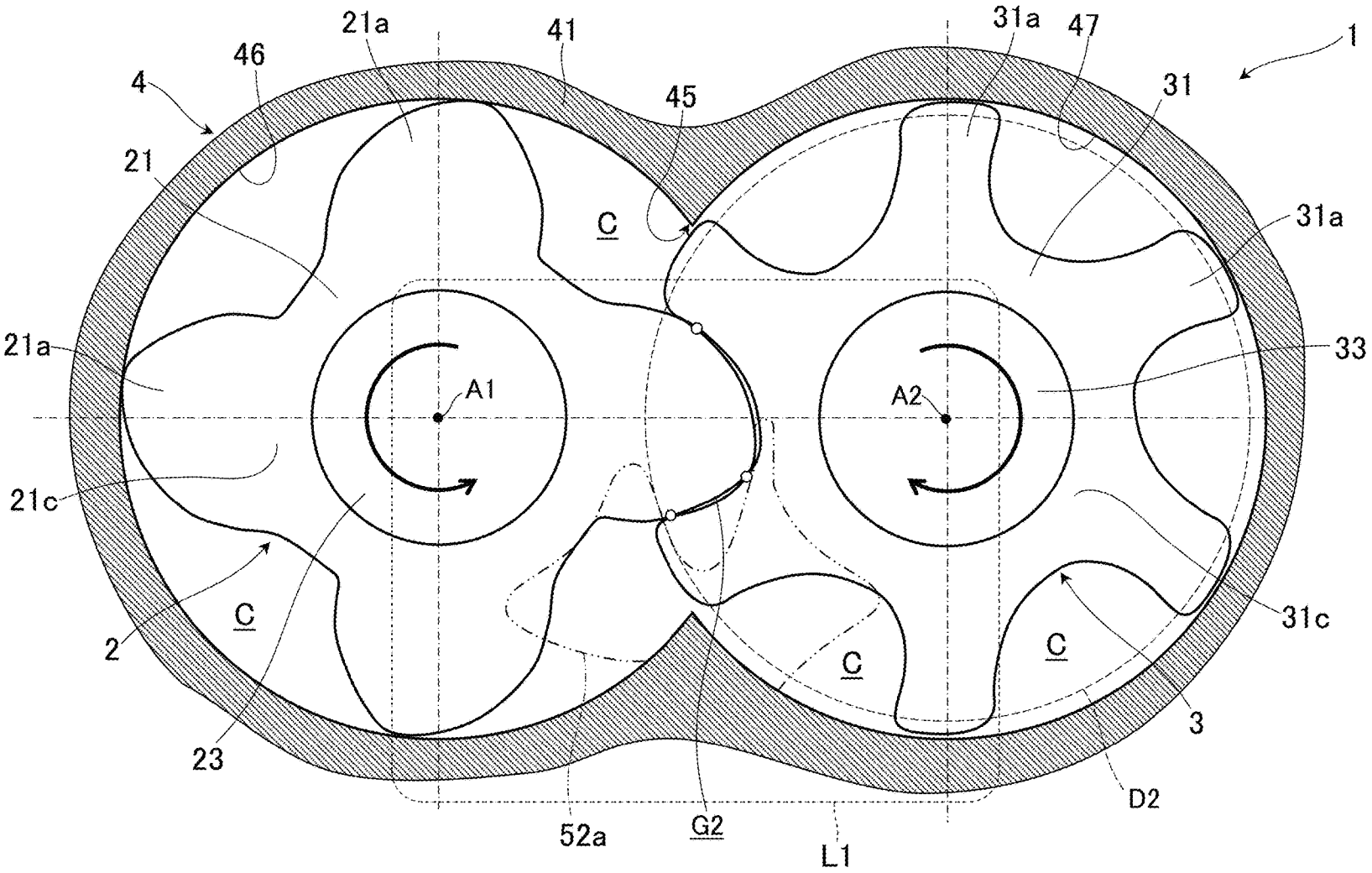
FIG. 2 is a cross-sectional view of the screw compressor according to the first embodiment of the present invention, taken along line II-II of FIG. 1.

The basic structure of a screw compressor according to a first embodiment will be described below with reference to FIGS. 1 and 2. FIG. 1 is a longitudinal cross-sectional view of a screw compressor according to the first embodiment of the present invention and a systematic diagram illustrating an external route for supplying oil to the screw compressor. FIG. 2 is a cross-sectional view of the screw compressor according to the first embodiment of the present invention, taken along line II-II of FIG. 1. In FIG. 1, the left side represents a suction side in an axial direction of the screw compressor and the right side represents a delivery side in the axial direction thereof. In FIG. 2, the thick-line arrows represent the rotational directions of screw rotors and the two-dot-and-dash line represents a delivery port of a casing as projected onto delivery end faces of the male and female rotors. In FIG. 2, an outer periphery side of the casing is omitted from illustration.

In FIG. 1, the oil-flooded screw compressor 1 (hereinafter referred to as "screw compressor") is supplied with oil (liquid) from an outside to the inside. The screw compressor 1 is connected to an external oil feed system 100 for supplying oil. The external oil feed system 100 includes, for example, devices such as an oil separator 101, an oil cooler 102, and an oil filter 103, and conduits 104 connecting those devices with each other.

In FIGS. 1 and 2, the screw compressor 1 includes a male rotor 2 (male-type screw rotor) and a female rotor 3 (female-type screw rotor) that are rotatable in mesh with each other, and a casing 4 in which the male and female rotors 2 and 3 are rotatably housed in a mutually meshed state. The male rotor 2 and the female rotor 3 are disposed such that their respective central axes A1 and A2 are parallel to each other. The male rotor 2 is rotatably supported on both sides thereof in the axial direction (left-right direction in FIG. 1) by a suction-side bearing 6 and delivery-side bearings 7 and 8, and is connected to a motor 90 as a rotational drive source. The female rotor 3 is rotatably supported on both sides thereof in the axial direction by a suction-side bearing and delivery-side bearings (both not shown).

The male rotor 2 includes a rotor lobe section 21 having a plurality of (four in FIG. 2) helical male lobes 21*a*, and a suction-side (left-side in FIG. 1) shaft section 22 and a delivery-side (right-side in FIG. 1) shaft section 23 that are disposed at both side ends in the axial direction of the rotor lobe section 21. The rotor lobe section 21 has a suction end face 21*b* and a delivery end face 21*c* respectively at one side end (left end in FIG. 1) and at the other side end (right end in FIG. 1) in the axial direction thereof. The suction-side shaft section 22 extends out of the casing 4 and is integral with the shaft of the motor 90, for example. A shaft seal member 9 such as an oil seal or a mechanical seal is placed on the suction-side shaft section 22 at a location closer to its distal end than the suction-side bearing 6.

The female rotor 3 includes a rotor lobe section 31 having a plurality of (six in FIG. 2) helical female lobes 31*a*, and a suction-side shaft section (not shown) and a delivery-side shaft section 33 that are disposed at both side ends in the axial direction (direction normal to the sheet of FIG. 2) of the rotor lobe section 31. The rotor lobe section 31 has a suction end face (not shown) and a delivery end face 31*c* respectively at one side end and at the other side end in the axial direction thereof.

The casing 4 includes a main casing 41 and a delivery-side casing 42 attached to a delivery side in the axial direction (right side in FIG. 1) of the main casing 41.

The casing 4 has a housing chamber (bore) 45 formed therein that houses the rotor lobe section 21 of the male rotor 2 and the rotor lobe section 31 of the female rotor 3 as they are held in mesh with each other. The housing chamber 45 is formed such that an opening on one side (right side in FIG. 1) of two cylindrical spaces that are formed in the main casing 41 in partly overlapping relation to each other is closed by the delivery-side casing 42. A wall face defining the housing chamber 45 includes a substantially cylindrical male-side inner periphery 46 that covers a radially-outward side of the rotor lobe section 21 of the male rotor 2; a substantially cylindrical female-side inner periphery 47 that covers a radially-outward side of the rotor lobe section 31 of the female rotor 3; a suction inner wall face 48 that faces the suction end faces 21*b* of the rotor lobe sections 21 and 31 of the male and female rotors 2 and 3, and a delivery inner wall face 49 that faces the delivery end faces 21*c* and 31*c* of the rotor lobe sections 21 and 31 of the male and female rotors 2 and 3. The rotor lobe sections 21 and 31 of the male and female rotors 2 and 3 are spaced respectively from the male-side inner periphery 46 and the female-side inner periphery 47 of the casing 4 by respective clearances ranging from several tens to several hundreds μm. The delivery end faces 21*c* and 31*c* of the male and female rotors 2 and 3 face the delivery inner wall face 49 of the casing 4 with a clearance (hereinafter referred to as "delivery-end-face clearance G1") ranging from several tens to several hundreds μm interposed therebetween. The rotor lobe sections 21 and 31 of the male and female rotors 2 and 3 and the inner wall face of the housing chamber 45 of the casing 4 (the male-side inner periphery 46, the female-side inner periphery 47, the suction inner wall face 48, and the delivery inner wall face 49) that surrounds the rotor lobe sections 21 and 31 form a plurality of working chambers C with different pressures.

As illustrated in FIG. 1, the suction-side bearings 6 on the male rotor 2 and the female rotor 3 are disposed in an end portion of the main casing 41 near the motor 90, and a suction-side cover 43 is attached to the end portion of the main casing 41 in covering relation to the suction-side bearing 6. The delivery-side bearings 7 and 8 on the male rotor 2 and the female rotor 3 are disposed in the delivery-side casing 42.

The casing 4 is provided with a suction fluid passage 51 for suction of air into the working chambers C (housing chamber 45). The casing 4 is also provided with a delivery fluid passage 52 for delivering compressed air from the working chambers C out of the casing 4. The delivery fluid passage 52 provides fluid communication between the housing chamber 45 (working chambers C) and the outside of the casing 4, and is connected to the external oil feed system 100. The delivery fluid passage 52 has a delivery port 52*a* (indicated by the two-dot-and-dash line in FIG. 2) formed at the delivery inner wall face 49 of the casing 4. The casing 4 is also provided with an oil feed passage 53 for supplying oil from the external oil feed system 100 to the working chambers C (housing chamber 45). The oil feed passage 53 opens to a region of the housing chamber 45 where the working chambers C are in a compression process, for example.

In the screw compressor 1 with the above structure, the male rotor 2 is driven by the motor 90 illustrated in FIG. 1, whereby the female rotor 3 illustrated in FIG. 2 is rotated. As the male and female rotors 2 and 3 are rotated, the working chambers C move axially. At this time, the working chambers C increase in volume to draw in air from outside of the casing 4 through the suction fluid passage 51 illustrated in FIG. 1, and decrease in volume to compress air to a predetermined pressure. The working chambers C come into fluid communication with the delivery port 52*a*, and then the compressed air in the working chambers C flows through the delivery fluid passage 52 via the delivery port 52*a* and is delivered into the oil separator 101 of the external oil feed system 100.

In the screw compressor 1, oil is supplied to the working chambers C, and thus the delivered compressed air contains oil. The oil contained in the compressed air is separated by the oil separator 101. The compressed air from which the oil has been removed in the oil separator 101 is supplied to an external piece of equipment when necessary.

The oil separated from the compressed air in the oil separator 101 is cooled by the oil cooler 102 of the external oil feed system 100, and then injected into the working chambers C through the oil feed passage 53 of the screw compressor 1. The oil can be supplied to the screw compressor 1 using the pressure of the compressed air flowing into the oil separator 101 as a drive source, without using a power source such as a pump.

Figure 3:
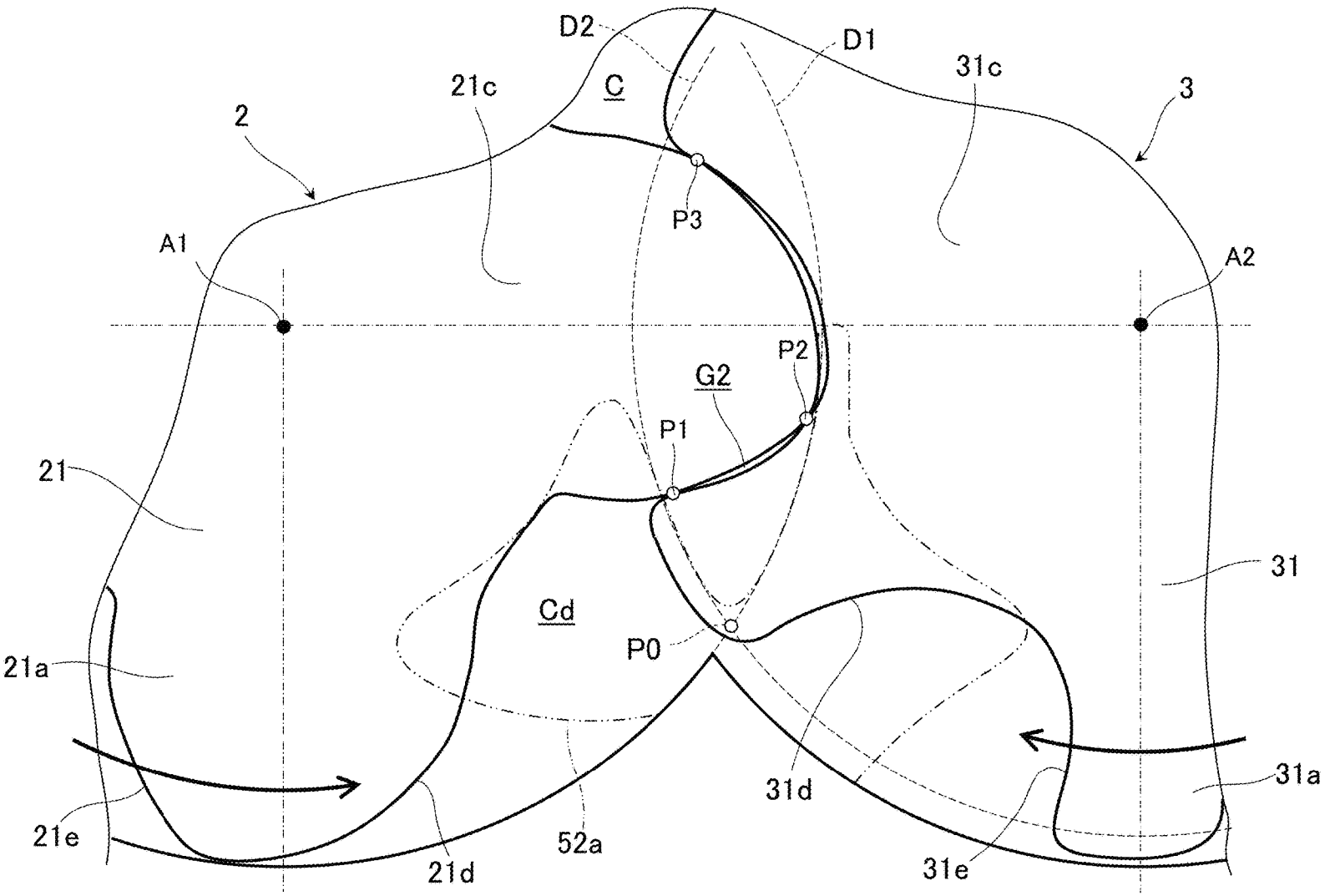
FIG. 3 is an enlarged view of a section of FIG. 2 that is indicated by the sign L1, the view illustrating an axial fluid communication path.

An axial fluid communication path as one of internal clearances in the screw compressor will be described below with reference to FIGS. 2 and 3. FIG. 3 is an enlarged view of a section of FIG. 2 that is indicated by the sign L1, the view illustrating the axial fluid communication path. In FIG. 3, the thick-line arrows represent the rotational directions of the male and female rotors, and the two-dot-and-dash line represents the delivery port as projected onto delivery end faces of the male and female rotors.

In the present description, as illustrated in FIG. 3, using a lobe tip of the male rotor 2 as a boundary, a flank of the lobe on a rotational direction side is defined as a leading flank 21*d* of the male rotor 2, and a flank of the lobe on a side opposite to the rotational direction is defined as a trailing flank 21*e* of the male rotor 2. Furthermore, using a lobe root of the female rotor 3 as a boundary, a flank of the lobe on a rotational direction side is defined as a leading flank 31*d* of the female rotor 3, and a flank of the lobe on a side opposite to the rotational direction is defined as a trailing flank 31*e* of the female rotor 3.

FIGS. 2 and 3 illustrate a meshing state of the male and female rotors 2 and 3 at a certain rotational angle. As illustrated in FIG. 3, the male rotor 2 and the female rotor 3 theoretically have at the delivery end faces 21*c* and 31*c* a meshing state in which they are in contact with each other at a total of three points. The three points at the delivery end faces 21*c* and 31*c* are a first contact point P1 where the trailing flank 21*e* of the male rotor 2 and the trailing flank 31*e* of the female rotor 3 contact each other, a second contact point P2 where a portion of the trailing flank 21*e* of the male rotor 2 that is closer to the lobe tip than the first contact point P1 and a portion of the trailing flank 31*e* of the female rotor 3 that is closer to the lobe root than the first contact point P1 contact each other, and a third contact point P3 where the leading flank 21*d* of the male rotor 2 and the leading flank 31*d* of the female rotor 3 contact each other.

An area surrounded by the first contact point P1, the second contact point P2, and the profiles the lobes of the male and female rotors 2 and 3 is an internal clearance referred to as an axial fluid communication path G2. The axial fluid communication path G2 is a crescent-shaped opening that is bounded by the trailing flanks 21*e* and 31*e* of the male and female rotors 2 and 3 to open only in the axial direction at the delivery end faces 21*c* and 31*c*. The axial fluid communication path G2 is periodically generated at the delivery end faces 21*c* and 31*c* according to variation of the intermeshing of the male and female rotors 2 and 3 upon rotation thereof.

Specifically, the axial fluid communication path G2 starts to occur in the vicinity of an intersection P0 on a delivery port 52*a* side of intersections between a tip circle D1 (broken line in FIG. 3) of the male rotor 2 and a pitch circle D2 (broken line in FIG. 3) of the female rotor 3, moves toward (upwardly in FIG. 2) a region between central axes A1 and A2 of the male and female rotors 2 and 3 while enlarging the area (size) of opening of its own upon rotation thereof, and finally disappears when the meshing state where the male and female rotors 2 and 3 contact each other at the three points is eliminated. The first contact point P1 exists in a zone within the pitch circle D2 of the female rotor 3, and the second contact point P2 exists in a zone within the tip circle D1 of the male rotor 2.

The pitch circle D2 of the female rotor 3 has its center aligned with the central axis A2 of the female rotor 3 and its diameter dpf calculated according to the following equation (1):

$$d_{pf} = 2a\frac{Z_f}{Z_m + Z_f} \tag{1}$$

where a, Zm, and Zf indicate the distance between the central axis A1 of the male rotor 2 and the central axis A2 of the female rotor 3, the number of the lobes of the male rotor 2, and the number of the lobes of the female rotor 3, respectively.

The axial fluid communication path G2 is communicated with a working chamber C in a suction process that is a relatively low pressure space, and, as illustrated in FIGS. 2 and 3, is in a position in the vicinity of the delivery fluid passage 52 (see FIG. 1) that is a relatively high pressure space and a working chamber Cd in a delivery process that is communicated with the delivery port 52*a*. Therefore, the axial fluid communication path G2 tends to cause the compressed air to flow from the delivery fluid passage 52 and the working chamber Cd in the delivery process back into the working chamber C in the suction process.

In order to restrain an internal leak of compressed air through the axial fluid communication path G2, the delivery inner wall face 49 of the casing 4 has a shield area 49*a* (see FIG. 4 to be described later) that shields at least a part, preferably most, of the track of the axial fluid communication path G2. However, some of the compressed air in the working chamber Cd in the delivery process and the delivery fluid passage 52 reaches the axial fluid communication path G2 via the delivery-end-face clearance G1 (see FIG. 1) between the delivery end faces 21*c* and 31*c* of the male and female rotors 2 and 3 and the shield area 49*a* of the delivery inner wall face 49 of the casing 4, flowing back into the low pressure space. This is one of the factors that cause a reduction in the compression performance and energy-saving performance of the compressor.

As regards the oil-flooded screw compressor, an oil film formed in part of the delivery-end-face clearance G1 by oil supplied to the working chambers C is expected to reduce an internal leak of compressed air through the delivery-end-face clearance G1. However, with regard to an internal leak via the axial fluid communication path G2, since the pressure difference between a high pressure space (the working chamber Cd in the delivery process and the delivery fluid passage 52) as a leakage source and a low pressure space (the working chamber C in the suction process) as a leakage destination is large compared to the other internal leaks, it is difficult to retain the oil film formed in the delivery-end-face clearance G1 in the vicinity of the axial fluid communication path G2, so that the oil film is less liable to reduce the internal leak.

The present embodiment is characterized in providing a groove structure for pressurizing an oil film formed in the delivery-end-face clearance G1 in the vicinity of the axial fluid communication path G2. The pressurized oil film formed in the delivery-end-face clearance G1 can be retained against an internal leak caused when the pressure difference between a space as a leakage source and a space as a leakage destination is large.

Figure 4:
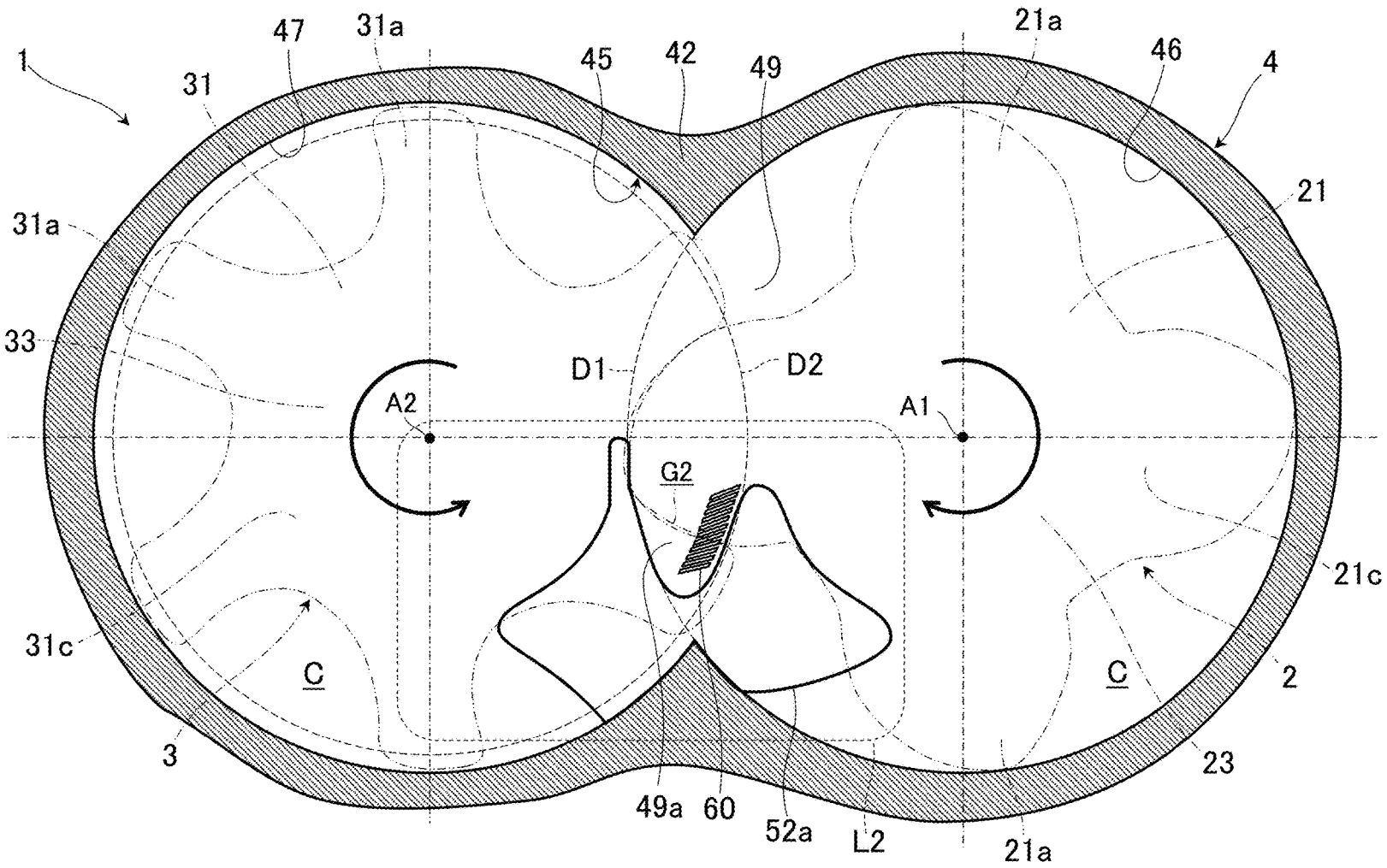
FIG. 4 is a cross-sectional view of the screw compressor according to the first embodiment of the present invention, taken along line IV-IV of FIG. 1.
Figure 5:
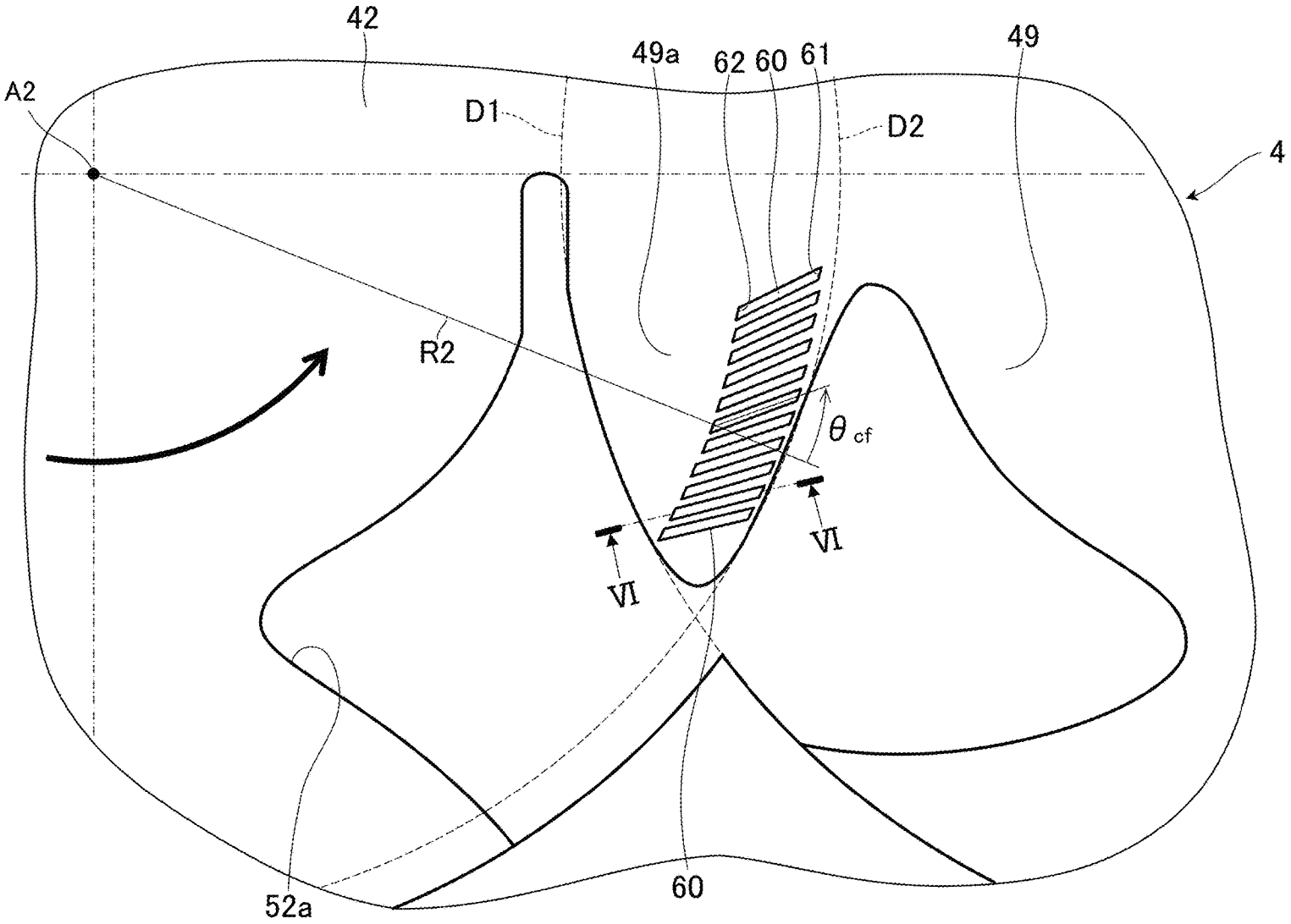
FIG. 5 is an enlarged view of a section of FIG. 4 that is indicated by the sign L2, the view illustrating a groove structure of a casing of the screw compressor according to the first embodiment of the present invention.
Figure 6:
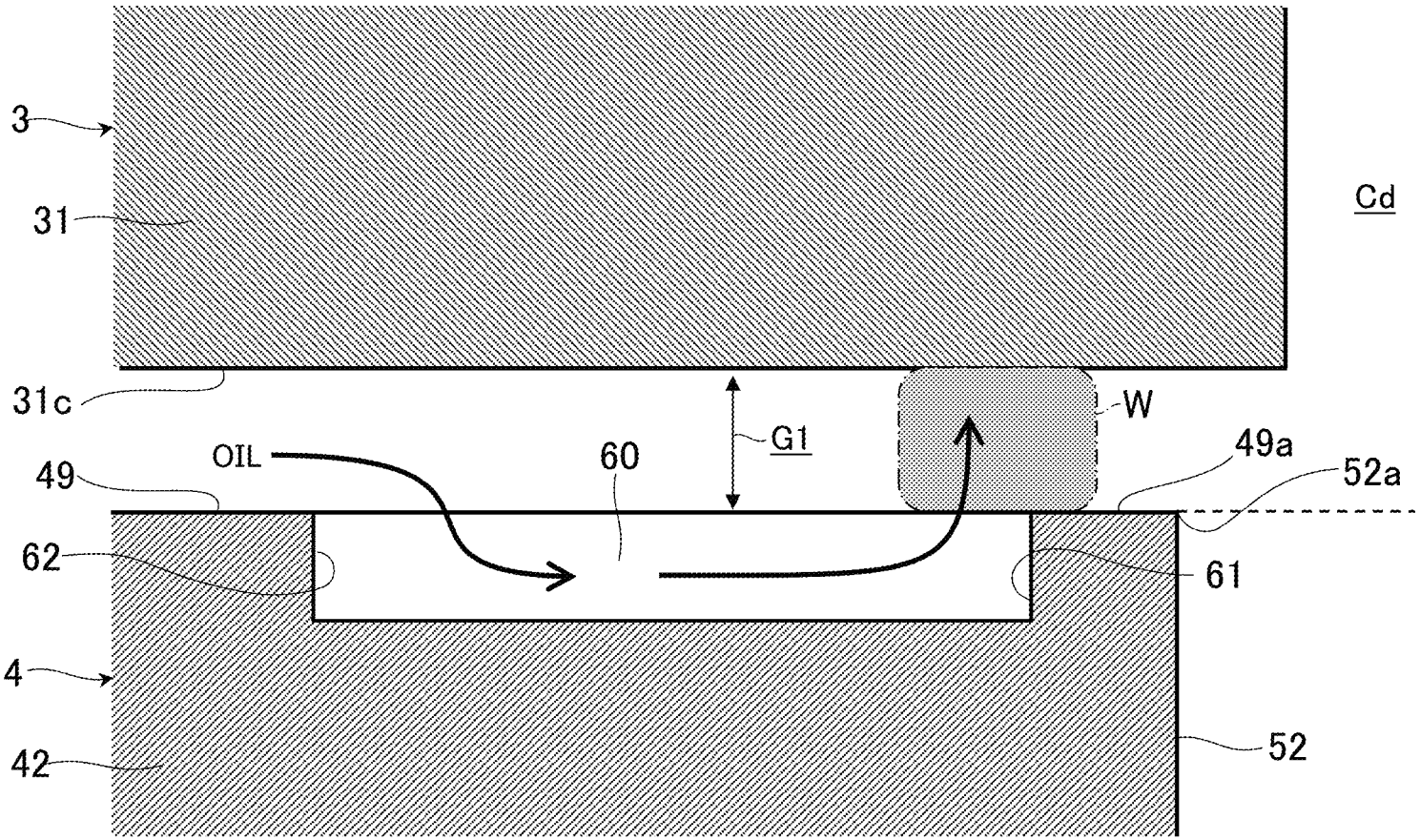
FIG. 6 is a cross-sectional view of the groove structure of the casing of the screw compressor according to the first embodiment of the present invention, taken along line VI-VI of FIG. 5.

Next, details of the groove structure of the screw compressor according to the first embodiment will be described below with reference to FIGS. 4 through 6. FIG. 4 is a cross-sectional view of the screw compressor according to the first embodiment of the present invention, taken along line IV-IV of FIG. 1. FIG. 5 is an enlarged view of a section of FIG. 4 that is indicated by the sign L2, the view illustrating a groove structure of a casing of the screw compressor according to the first embodiment of the present invention. FIG. 6 is a cross-sectional view of the groove structure of the casing of the screw compressor according to the first embodiment of the present invention, taken along line VI-VI of FIG. 5. In FIGS. 4 and 5, the two-dot-and-dash lines represent the shapes of the delivery end faces of the male and female rotors as axially projected onto the delivery inner wall face of the casing at a time when the male and female rotors are at a certain rotational angle (at the time when the axial fluid communication path is formed), and the thick-line arrows represent the rotational directions of the rotors. In FIG. 4, an outer periphery side of the casing is omitted from illustration.

As illustrated in FIG. 4, the delivery inner wall face 49 of the casing 4 is provided with the delivery port 52*a* as an entrance of the delivery fluid passage 52 (see FIG. 1). The delivery port 52*a* is formed generally so as not to overlap an area where the track of the axial fluid communication path G2 is projected onto the delivery inner wall face 49 in the direction of the rotor axis, for example, in order to reduce an internal leak of compressed air via the axial fluid communication path G2.

In other words, the delivery inner wall face 49 has the shield area 49*a* for restraining an internal leak via the axial fluid communication path G2. The shield area 49*a* shields at least a part, preferably most, of the track of the axial fluid communication path G2, and is established so as to overlap at least a part, preferably most, of the area where the track is projected onto the delivery inner wall face 49 in the direction of the rotor axis. According to a specific example, the shield area 49*a* is a portion in an area obtained by a region surrounded by the tip circle D1 of the male rotor 2 and the pitch circle D2 of the female rotor 3 being projected onto the delivery inner wall face 49 in the axial direction of the rotors, which the portion is on a delivery port 52*a* side from the region between central axes A1 and A2 of the male and female rotors 2 and 3. The shield area 49*a* has its outer edge making up a part of the contour of the delivery port 52*a*, and is shaped as a tongue-like protrusion protruding toward the center of the delivery port 52*a*, for example. The shield area 49*a* of the delivery inner wall face 49 minimizes direct fluid communication areas (confronting areas) of the axial fluid communication path G2 and the delivery port 52*a*.

As illustrated in FIGS. 4 and 5, the shield area 49*a* of the delivery inner wall face 49 is provided with a groove group made up of a plurality of grooves 60 into which part of oil (liquid) supplied to the working chambers C can flow. The grooves 60 are arrayed in juxtaposition along a contour line of the shield area 49*a* near the pitch circle D2 (near the male rotor 2) of the female rotor 3, for example. Namely, the grooves 60 are juxtaposed circumferentially around the central axis A2 of the female rotor 3. Each of the grooves 60 is shaped as an elongated groove having a longitudinal direction. The grooves 60 are arranged such that their sides extending in the longitudinal directions are disposed adjacent to each other.

As illustrated in FIG. 5, each of the grooves 60 has one end 61 in the longitudinal direction positioned on an outer circumferential side of the female rotor 3 compared to the other end 62, and extends straight from the other end 62 toward the one end 61, for example. The grooves 60 are configured such that their longitudinal directions oriented from the other end 62 toward the one end 61 (oriented from an inner circumferential side of the female rotor 3 toward the outer circumferential side thereof) are inclined at an angle of θcf with respect to a radial direction R2 of the female rotor 3 in the same direction as the rotational direction of the female rotor 3. The grooves 60 are restricted to a position inside of the pitch circle D2 of the female rotor 3 and a position short of the contour line of the shield area 49*a* (an opening edge of the delivery port 52*a*).

As illustrated in FIG. 6, the grooves 60 have a substantially constant depth. The grooves 60 are intended as a type of dynamic pressure groove the details of which are to be described later. The depth of the grooves 60 as dynamic pressure grooves has an appropriate value depending on the magnitude of a shear force to be described later that acts on the oil that has flowed into the grooves 60. For example, providing the delivery-end-face clearance G1 is in the range from several tens to 200 μm, the grooves 60 should preferably have a depth in the range from 1 μm to 1 mm. Each of the grooves 60 has an end face at the one end 61 (at the outer-circumferential-side end) that is joined to the bottom thereof substantially at a right angle. However, from the standpoint of machinability or the like, the end face at the one end 61 of the groove 60 and the bottom thereof may be joined to each other by a slanted surface or a curved surface.

Figure 7:
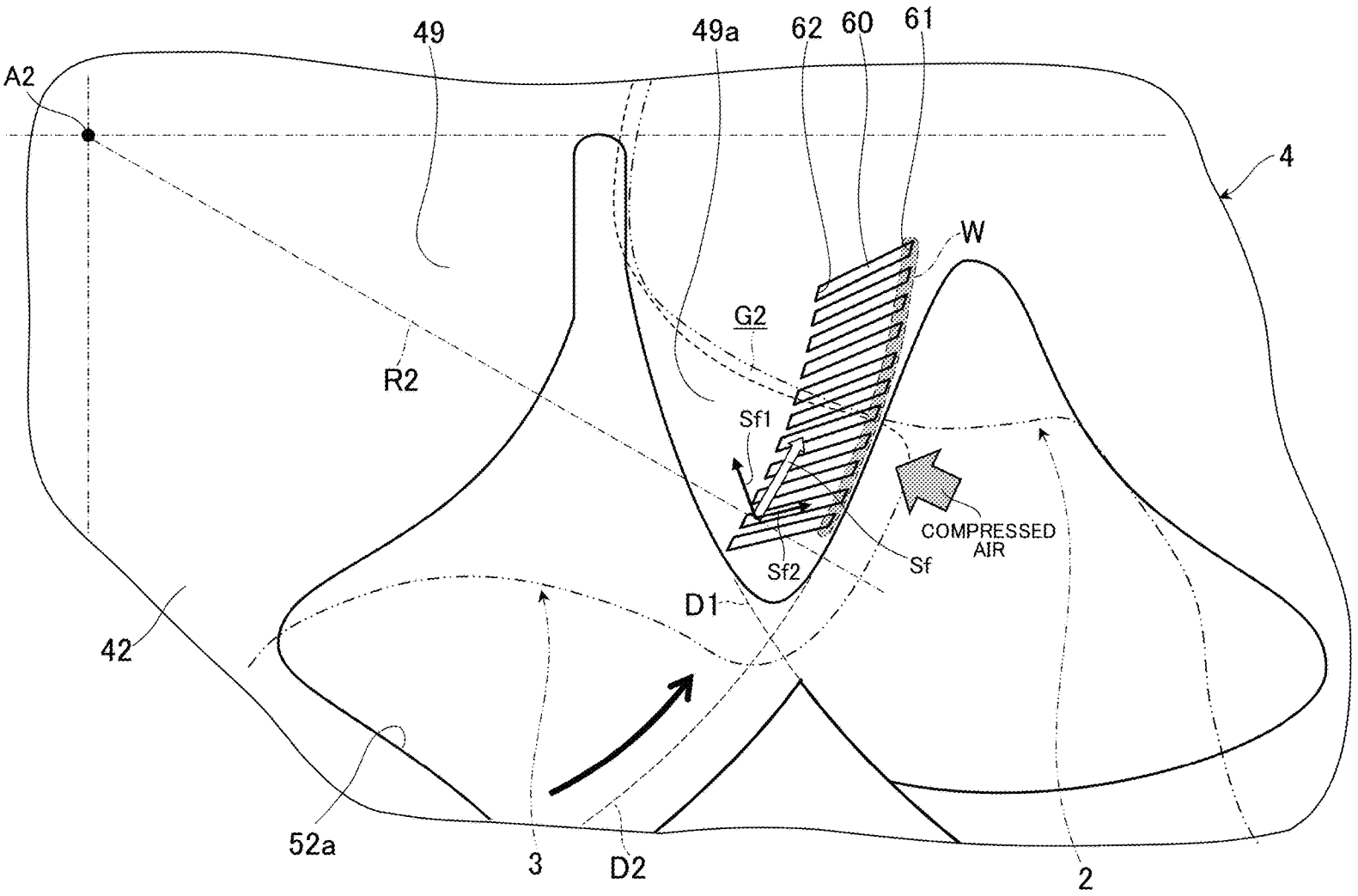
FIG. 7 is a view illustrating the manner in which the groove structure of the casing of the screw compressor according to the first embodiment of the present invention operates.

Next, operation and advantages of the groove structure of the casing in the screw compressor according to the first embodiment will be described below with reference to FIGS. 6 and 7. FIG. 7 is a view illustrating the manner in which the groove structure of the casing of the screw compressor according to the first embodiment of the present invention operates. FIG. 6 illustrates the female rotor when it confronts the shield area of the casing. In FIG. 6, the thick-line arrows represent a flow of oil. In FIG. 7, the two-dot-and-dash lines represent the shapes of the delivery end faces of the female and male rotors as projected onto the delivery inner wall face of the casing in the direction of the rotor axis.

In the screw compressor 1 according to the present embodiment, a shear force Sf is caused by the delivery end face 31*c* of the rotating female rotor 3 to act on the oil that has flowed into the grooves 60 formed in the shield area 49*a* of the delivery inner wall face 49 of the casing 4 illustrated in FIGS. 6 and 7, in a direction tangential to the rotational direction of the female rotor 3 (a direction perpendicular to the radial directions R2 of the female rotor 3) and in the same direction as the rotational direction thereof. The shear force Sf can be resolved into a first component force Sf1 that is a component force in a direction perpendicular to the longitudinal direction of the grooves 60 and a second component force Sf2 that is a component force in the longitudinal direction of the grooves 60.

According to the present embodiment, each of the grooves 60 extends so as to be inclined at the other end 62 as a base point with respect to the radial directions R2 of the female rotor 3 in the same direction as the rotational direction of the female rotor 3. The second component force Sf2 thus becomes a force oriented toward the outer circumferential side of the female rotor 3 in the longitudinal direction of the grooves 60. Therefore, the oil in each of the grooves 60 is caused to flow toward the outer circumferential side of the female rotor 3 along the longitudinal direction of the grooves 60 by the second component force Sf2 of the shear force Sf. As illustrated in FIGS. 6 and 7, the oil flowing in the groove 60 is dammed at the one end 61 as an end on the outer circumferential side of the female rotor 3 in the longitudinal direction of the groove 60, thereby its kinetic energy (dynamic pressure) is converted to cause a static pressure buildup. Then, the oil finally flows out into the delivery-end-face clearance G1 (toward the female rotor 3) in the region of the one end 61. Accordingly, the pressure of oil in the delivery-end-face clearance G1 becomes relatively higher in the vicinity of the one end 61 of the groove 60.

According to the present embodiment, as illustrated in FIG. 7, the grooves 60 are juxtaposed such that their sides extending in the longitudinal directions are disposed adjacent to each other. Consequently, the pressurized oil flows out of the one end 61 (the end on the outer circumferential side of the female rotor) of each of the grooves 60 into the delivery-end-face clearance G1. The respective flows of high-pressure oil that have flowed out of the one ends 61 of the grooves 60 are joined together, promoting the formation of a high-pressure oil film W along the one ends 61 of the grooves 60 in the delivery-end-face clearance G1. The closer the one ends 61 of the grooves 60 are positioned to the outer circumferential side of the female rotor 3, the larger the shear force acting on the oil becomes upon rotation of the female rotor 3, resulting in a corresponding increase in the ability of the oil film W to restrain an internal leak due to the pressure buildup.

As described above, not only the oil in the grooves 60 seals the delivery-end-face clearance G1, but also the oil that has flowed out of the grooves 60 into the vicinity of the contour close to the male rotor 2 (close to the pitch circle D2) in the shield area 49*a* of the casing 4 forms the oil film W that is higher in pressure than in a peripheral region. While the axial fluid communication path G2 is overlapping the shield area 49*a* with the delivery-end-face clearance G1 interposed therebetween, the high-pressure oil film W prevents the compressed air in the delivery fluid passage 52 (see FIG. 1) and the working chamber Cd in the delivery process (high pressure space) from leaking from the edge of the shield area 49*a* near the male rotor 2 via the axial fluid communication path G2 into the working chamber in the suction process (low pressure space). The oil behavior described above makes it possible to increase the compression performance and energy-saving performance of the screw compressor 1.

The groove structure (the grooves 60) according to the present embodiment dams oil flowing under the shear force Sf by the one ends 61, to thereby convert the dynamic pressure of the oil into a static pressure to form the high-pressure oil film W, and can be referred to as a type of dynamic pressure groove. The depth of each of the grooves 60 can be set to an appropriate value (e.g., in the range from 1 μm to 1 mm) capable of maximizing the pressure of the oil film W, depending on the magnitude of the shear force Sf acting on the oil and the size of the delivery-end-face clearance G1, thereby further restraining an internal leak via the axial fluid communication path G2.

According to the present embodiment, each of the grooves 60 is disposed within the pitch circle D2 of the female rotor 3 and is formed out of fluid communication with the delivery port 52*a*. This prevents the grooves 60 from simultaneously communicating with the working chamber Cd in the delivery process and the axial fluid communication path G2 to become routes for an internal leak.

According to the present embodiment, the casing 4 as part of a stationary body has the grooves 60. Therefore, the grooves 60 do not move with the screw rotors, but are in fixed positions with respect to the delivery port 52*a* of the casing 4 and the track of the axial fluid communication path G2. Thus, the grooves 60 are expected to have a stable ability to restrain an internal leak via the axial fluid communication path G2.

First Modification of First Embodiment

Figure 8:
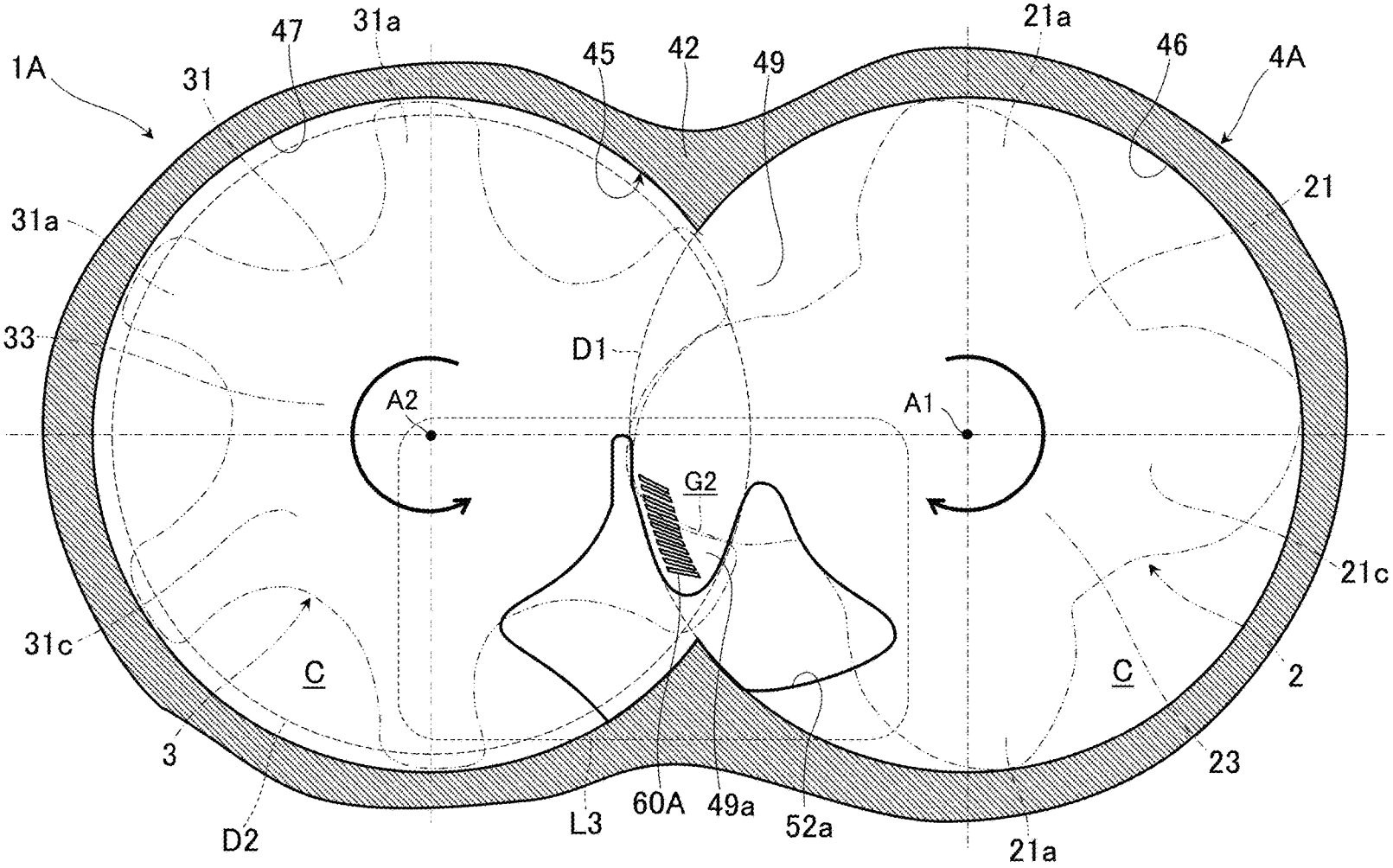
FIG. 8 is a cross-sectional view of a screw compressor according to a modification of the first embodiment of the present invention, taken along the same line as FIG. 4.
Figure 9:
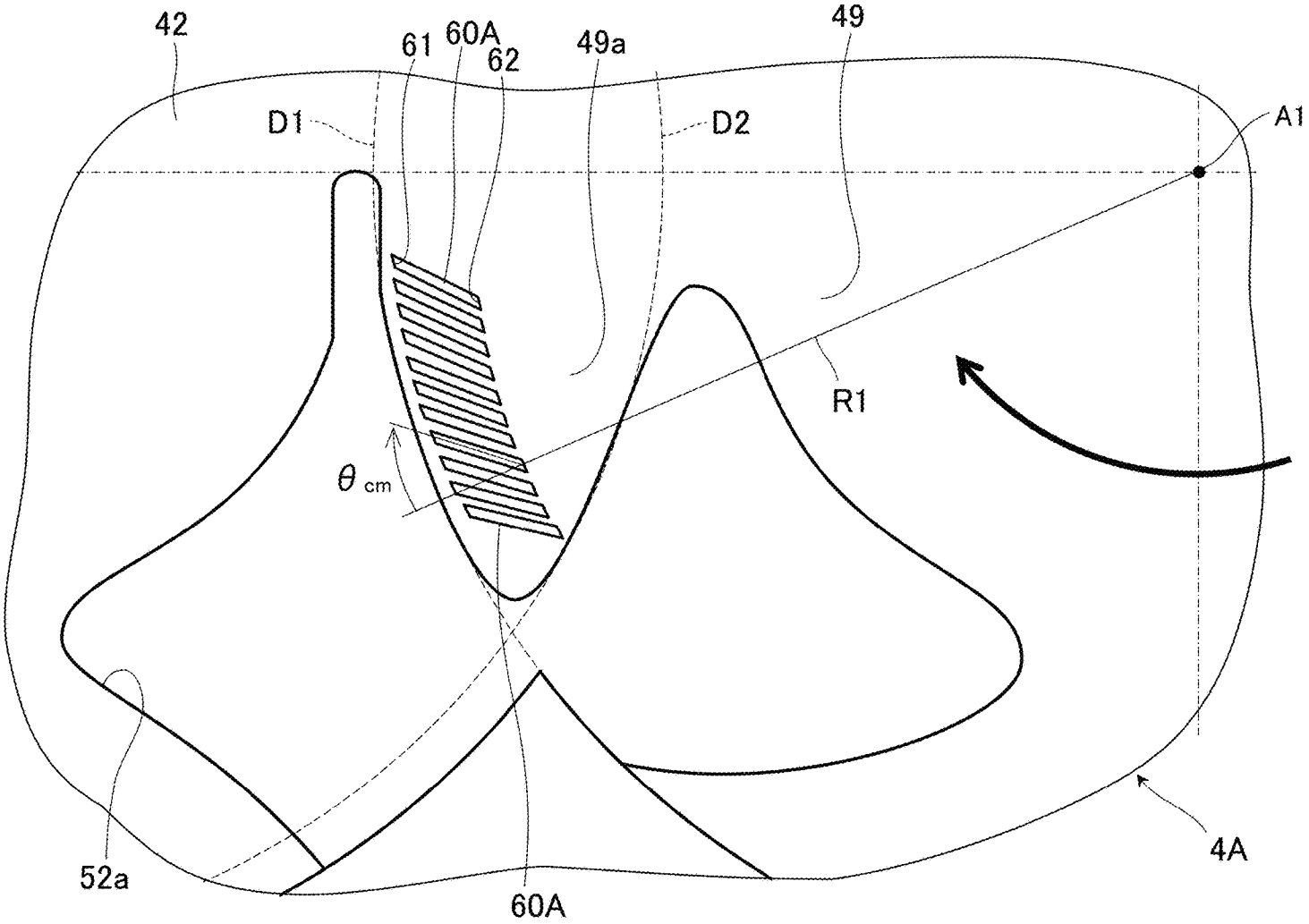
FIG. 9 is an enlarged view of a section of FIG. 8 that is indicated by the sign L3, the view illustrating a groove structure of a casing of the screw compressor according to the modification of the first embodiment of the present invention.
Figure 10:
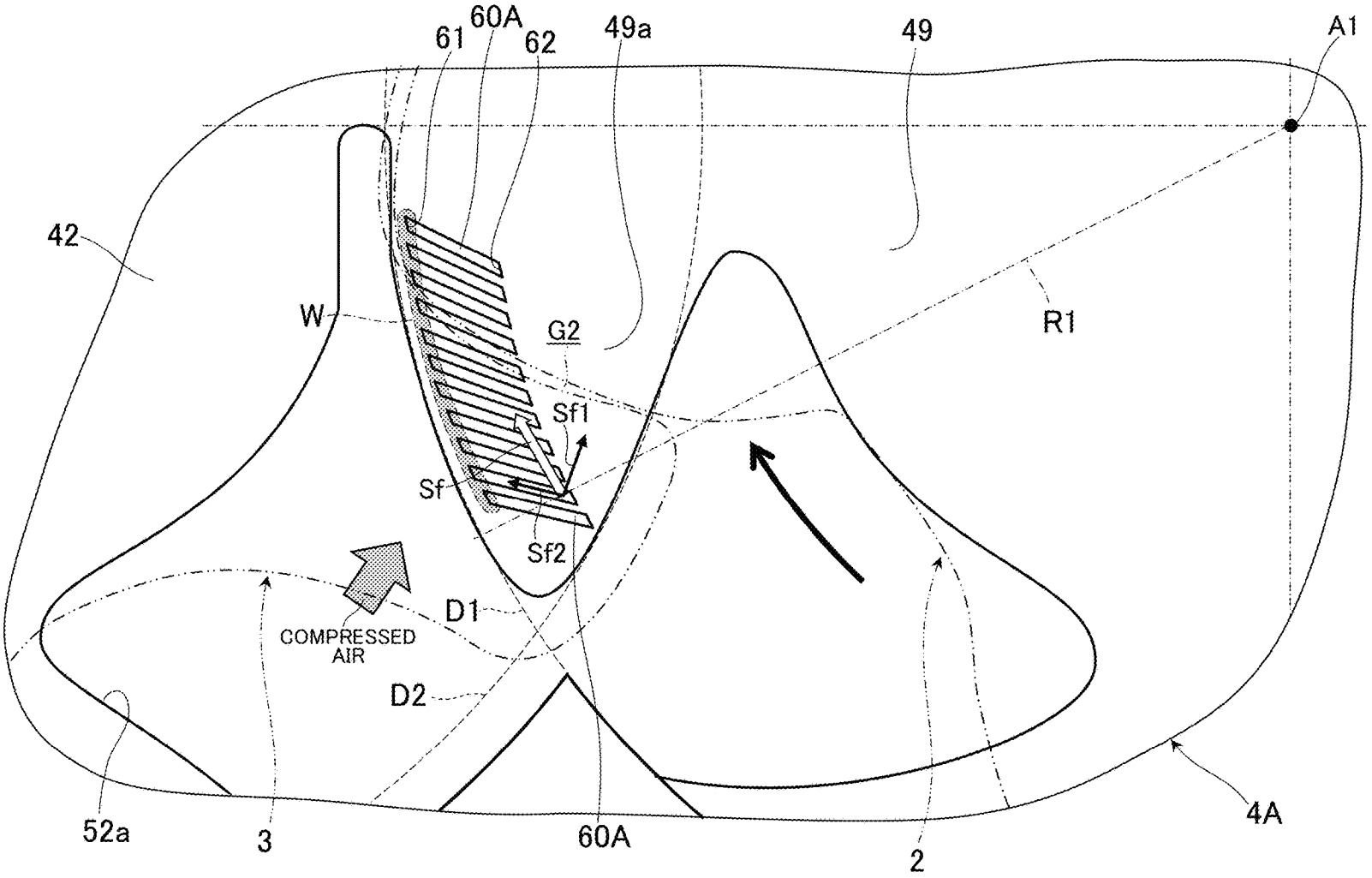
FIG. 10 is a view illustrating the manner in which the groove structure of the casing of the screw compressor according to the modification of the first embodiment of the present invention operates.

A screw compressor according to a first modification of the first embodiment will be described by way of example below with reference to FIGS. 8 through 10. FIG. 8 is a cross-sectional view of the screw compressor according to the modification of the first embodiment of the present invention, taken along the same line as FIG. 4. FIG. 9 is an enlarged view of a section of FIG. 8 that is indicated by the sign L3, the view illustrating a groove structure of a casing of the screw compressor according to the modification of the first embodiment of the present invention. FIG. 10 is a view illustrating the manner in which the groove structure of the casing of the screw compressor according to the modification of the first embodiment of the present invention operates. In FIG. 8, an outer periphery side of the casing is omitted from illustration. In FIGS. 8 through 10, those parts denoted by the same characters as those illustrated in FIGS. 1 through 7 are similar parts and will be omitted from detailed description.

The screw compressor 1A according to the first modification of the first embodiment, illustrated in FIGS. 8 and 9, is generally of a similar configuration to the first embodiment, but is different therefrom as to the disposed position and the shape of a plurality of grooves 60A formed at a delivery inner wall face 49 of a casing 4A.

Specifically, the shield area 49*a* of the delivery inner wall face 49 of the casing 4A is provided with a groove group made up of a plurality of grooves 60A. The grooves 60A are arrayed in juxtaposition along a contour line of the shield area 49*a* near the tip circle D1 of the male rotor 2 (near the female rotor 3). Namely, the grooves 60 are juxtaposed circumferentially around the central axis A1 of the male rotor 2. Each of the grooves 60A is shaped as an elongated groove having a longitudinal direction. The grooves 60A are formed such that their sides extending in the longitudinal directions are disposed adjacent to each other.

As illustrated in FIG. 9, each of the grooves 60A has one end 61 in the longitudinal direction positioned on an outer circumferential side of the male rotor 2 compared to the other end 62, and extends straight from the other end 62 toward the one end 61, for example. The grooves 60A are configured such that their longitudinal directions oriented from the other end 62 toward the one end 61 (oriented from an inner circumferential side of the male rotor 2 toward the outer circumferential side) are inclined at an angle θcm with respect to a radial direction R1 of the male rotor 2 in the same direction as the rotational direction of the male rotor 2. The grooves 60A are restricted to a position inside of the tip circle D1 of the male rotor 2 and a position short of the contour line of the shield area 49*a* (an opening edge of the delivery port 52*a*).

According to the present modification, the oil that has flowed into the grooves 60A formed on the shield area 49*a* of the delivery inner wall face 49 of the casing 4A illustrated in FIG. 8 is dragged by the delivery end face 21*c* of the rotating male rotor 2. As illustrated in FIG. 10, a shear force Sf acts on the oil that has flowed into the grooves 60A in a direction tangential to the rotational direction of the male rotor 2 (a direction perpendicular to the radial direction R1 of the male rotor 2) and in the same direction as the rotational direction thereof. The shear force Sf that acts on the oil in the grooves 60A can be resolved into a first component force Sf1 that is a component force in a direction perpendicular to the longitudinal directions of the grooves 60A and a second component force Sf2 that is a component force in the longitudinal directions of the grooves 60A.

According to the present modification, as illustrated in FIG. 9, each of the grooves 60A extends so as to be inclined at the other end 62 as a base point with respect to the radial direction R1 of the male rotor 2 in the same direction as the rotational direction of the male rotor 2. As illustrated in FIG. 10, the second component force Sf2 thus becomes a force oriented toward the outer circumferential side of the male rotor 2 in the longitudinal directions of the grooves 60A. Therefore, the oil in each of the grooves 60A is caused to flow toward the outer circumferential side of the male rotor 2 along the longitudinal direction of the groove 60A by the second component force Sf2. The oil flowing in the groove 60A is dammed at the one end 61 as the end on the outer circumferential side of the male rotor 2 in the longitudinal direction of the groove 60A, thereby its kinetic energy (dynamic pressure) is converted to cause a static pressure buildup. The oil finally flows out into the delivery-end-face clearance G1 (toward the male rotor 2) in the region of the one end 61. Accordingly, the pressure of oil in the delivery-end-face clearance G1 becomes highest in the vicinity of the one ends 61 of the grooves 60A.

According to the present modification, as illustrated in FIG. 9, the grooves 60A are juxtaposed such that their sides extending in the longitudinal directions are disposed adjacent to each other. Consequently, as illustrated in FIG. 10, the pressurized oil flows out of the one end 61 (the end on the outer circumferential side of the male rotor) of each of the grooves 60A into the delivery-end-face clearance G1. The respective flows of high-pressure oil that have flowed from the one ends 61 are joined together, promoting the formation of a high-pressure oil film W along the one ends 61 of the grooves 60A in the delivery-end-face clearance G1. The closer the one ends 61 of the grooves 60A are positioned to the outer circumferential side of the male rotor 2, the larger the shear force Sf acting on the oil becomes upon rotation of the male rotor 2, resulting in a corresponding increase in the ability of the oil film W to restrain an internal leak due to the pressure buildup.

In this manner, not only the oil in the grooves 60A seals the delivery-end-face clearance G1, but also the oil that has flowed out of the grooves 60A into the vicinity of the contour on the female rotor 3 side (on the tip circle D1 side) of the shield area 49*a* of the casing 4A forms the oil film W that is higher in pressure than in the peripheral region. While the axial fluid communication path G2 is overlapping the shield area 49*a* with the delivery-end-face clearance G1 interposed therebetween, the high-pressure oil film W prevents the compressed air in the delivery fluid passage 52 (see FIG. 1) and the working chamber Cd in the delivery process (high pressure space) from leaking from the edge of the shield area 49*a* near the female rotor 3 via the axial fluid communication path G2 into the working chamber in the suction process (low pressure space). The oil behavior described above makes it possible to increase the compression performance and energy-saving performance of the screw compressor 1A.

According to the present modification, each of the grooves 60A is disposed within the tip circle D1 of the male rotor 2 and is formed out of fluid communication with the delivery port 52*a*. This prevents the grooves 60A from simultaneously communicating with the working chamber Cd in the delivery process and the axial fluid communication path G2 to become routes for an internal leak.

The first embodiment and the modification thereof as described above are summarized as follows: The screw compressor 1, 1A according to the first embodiment and the modification thereof includes the male rotor 2 having the first delivery end face 21*c* on the one side in the axial direction, the female rotor 3 having the second delivery end face 31*c* on the one side in the axial direction, and the casing 4 having the housing chamber 45 in which the male rotor 2 and the female rotor 3 are rotatably housed in a mutually meshed state. The casing 4 has the delivery inner wall face 49 that faces the first delivery end face 21*c* of the male rotor 2 and the second delivery end face 31*c* of the female rotor 3, and the delivery inner wall face 49 of the casing 4 has the shield area 49*a* that shields at least a part of the track of the axial fluid communication path G2. the axial fluid communication path G2 is a clearance that is periodically generated at the first delivery end face 21*c* and the second delivery end face 31*c* according to the variation of the intermeshing of the male rotor 2 and female rotor 3 upon rotation thereof and that is bounded by the trailing flanks of the male rotor 2 and the female rotor 3. The shield area 49*a* of the casing 4 is provided with the groove group made up of the grooves 60, 60A having the longitudinal directions. The grooves 60, 60A of the groove group are juxtaposed in the circumferential direction of at least one rotor of the male rotor 2 and the female rotor 3 and are arranged such that their sides extending in the longitudinal directions are disposed adjacent to each other. Each of the grooves 60, 60A is configured such that the longitudinal direction from the inner circumferential side of the one rotor (the male rotor 2 or the female rotor 3) toward the outer circumferential side is inclined with respect to the radial direction of the one rotor (the male rotor 2 or the female rotor 3) in the same direction as the rotational direction of the one rotor (the male rotor 2 or the female rotor 3).

With this configuration, the oil (liquid) in the plurality of grooves 60, 60A provided on the delivery inner wall face 49 of the casing 4 is caused to flow in the longitudinal directions by the shear force and is then dammed, resulting in an increase in the static pressure of the oil. This allows the high-pressure oil film W (liquid film) to be formed in the vicinity of the axial fluid communication path G2 in the delivery-end-face clearance G1. Therefore, it is possible to reduce an internal leak of compressed gas via the axial fluid communication path G2.

Second Embodiment

Figure 11:
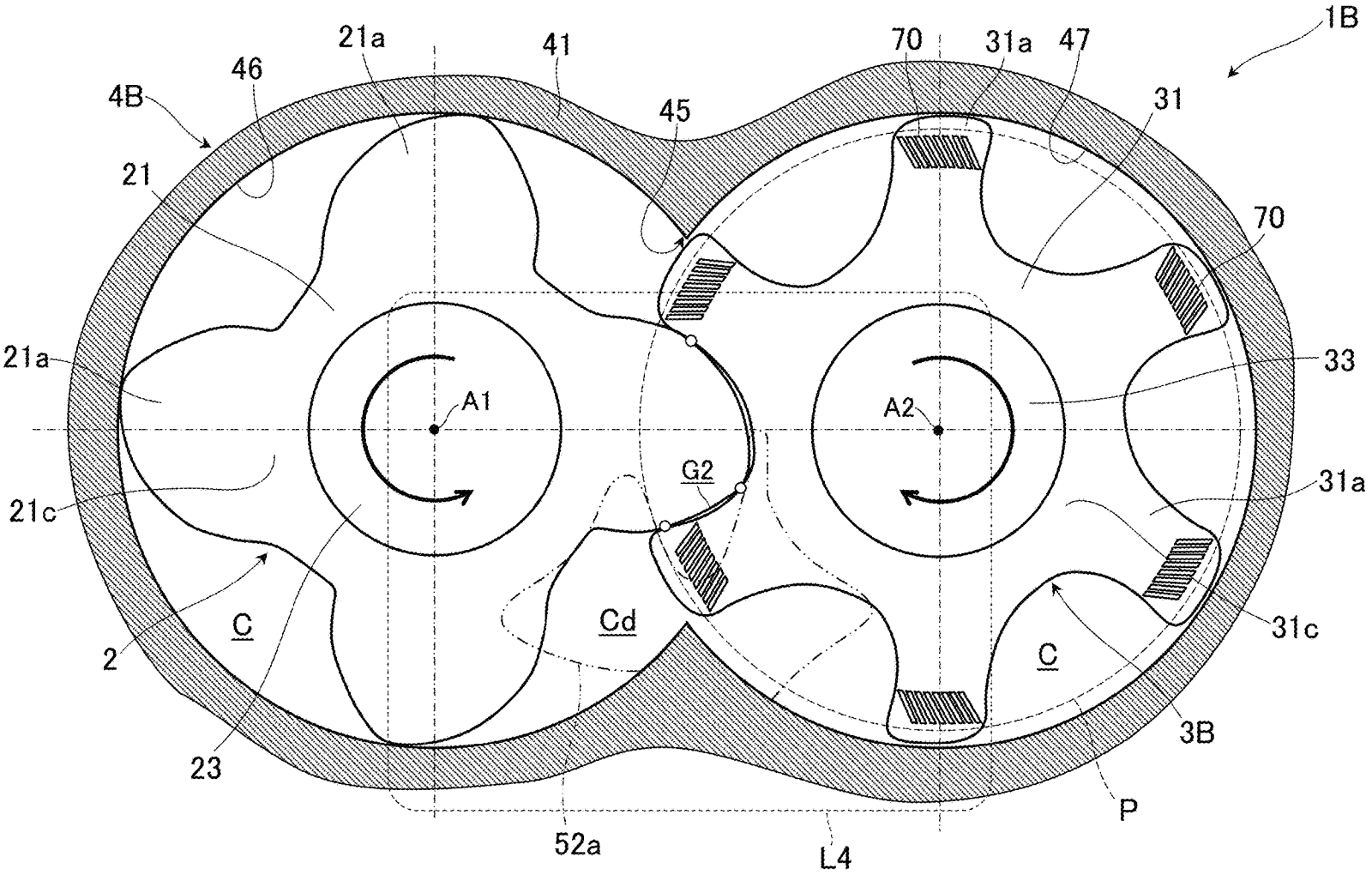
FIG. 11 is a cross-sectional view of a screw compressor according to a second embodiment of the present invention, taken along the same line as FIG. 2.
Figure 12:
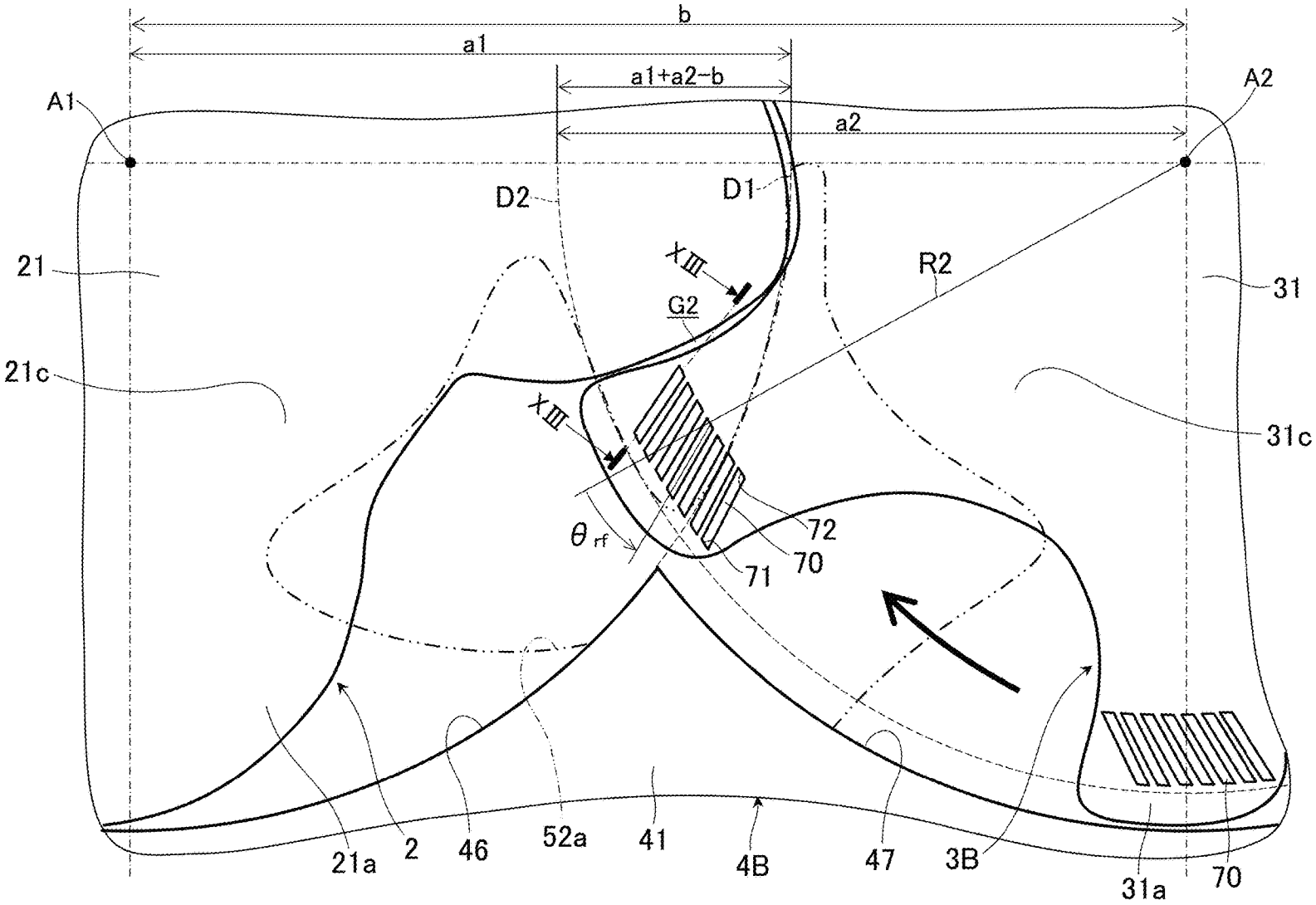
FIG. 12 is an enlarged view of a section of FIG. 11 that is indicated by the sign L4, the view illustrating a groove structure of a screw rotor of the screw compressor according to the second embodiment of the present invention.
Figure 13:
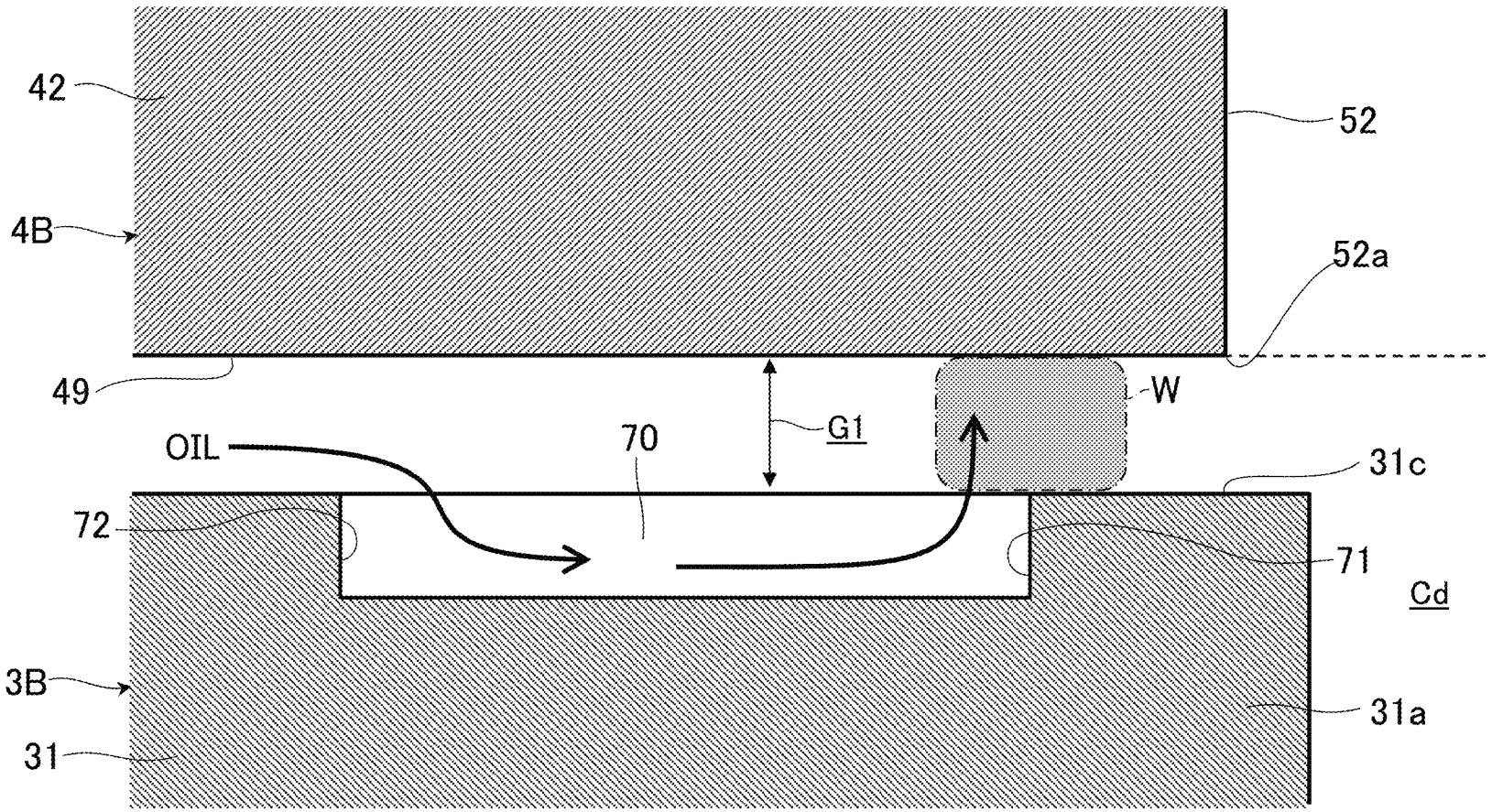
FIG. 13 is a cross-sectional view of the groove structure of the screw rotor of the screw compressor according to the second embodiment of the present invention, taken along line XIII-XIII of FIG. 12.

The configuration and structure of a screw compressor according to a second embodiment will be described below with reference to FIGS. 11 through 13. FIG. 11 is a cross-sectional view of the screw compressor according to the second embodiment of the present invention, taken along the same line as FIG. 2. FIG. 12 is an enlarged view of a section of FIG. 11 that is indicated by the sign L4, the view illustrating a groove structure of a screw rotor of the screw compressor according to the second embodiment of the present invention. FIG. 13 is a cross-sectional view of the groove structure of the screw rotor of the screw compressor according to the second embodiment of the present invention, taken along line XIII-XIII of FIG. 12. In FIGS. 11 and 12, the two-dot-and-dash line represents the shape of the contour of the delivery port on the delivery inner wall face of the casing as projected onto the delivery end faces of the male and female rotors, and the thick-line arrows represent the rotational directions of the rotors. In FIG. 11, an outer periphery side of the casing is omitted from illustration. In FIGS. 11 through 13, those parts denoted by the same characters as those illustrated in FIGS. 1 through 10 are similar parts and will be omitted from detailed description.

The screw compressor 1B, illustrated in FIG. 11, according to the second embodiment is different from that in the first embodiment in that a groove structure for forming a high-pressure oil film W is formed not on the delivery inner wall face 49 of a casing 4B but on the delivery end face 31*c* of a female rotor 3B. In other words, the delivery inner wall face 49 of the casing 4B is free of the groove structure according to the first embodiment.

Specifically, as illustrated in FIGS. 11 and 12, a tip area of each female lobe 31*a* on the delivery end face 31*c* of the female rotor 3B is provided with a groove group made up of a plurality of grooves 70. The grooves 70 are juxtaposed in a thickness direction of each lobe tip. In other words, the grooves 70 are juxtaposed circumferentially around the central axis A2 of the female rotor 3B. Each of the grooves 70 is shaped as an elongated groove having a longitudinal direction. The grooves 70 are arranged such that their sides extending in the longitudinal directions are disposed adjacent to each other.

As illustrated in FIG. 12, each of the grooves 70 has one end 71 in the longitudinal direction positioned on the outer circumferential side of the female rotor 3B compared to the other end 72, and extends straight from the other end 72 (the end on the inner circumferential side) toward the one end 71 (the end on the outer circumferential side), for example. The grooves 70 are configured such that their longitudinal directions oriented from the other end 72 (the end on the inner circumferential side) toward the one end 71 (the end on the outer circumferential side) are inclined at an angle θrf with respect to the radial direction R2 of the female rotor 3B in a direction opposite to the rotational direction of the female rotor 3B. The grooves 70 are restricted to a position inside of the pitch circle D2 of the female rotor 3B and a position short of the contour line of the female lobes 31*a* of the female rotor 3B.

Providing the distance from the central axis A1 of the male rotor 2 to the tip circle D1 of the male rotor 2 is indicated by a1, the distance from the central axis A2 of the female rotor 3B to the pitch circle D2 of the female rotor 3B is indicated by a2, and the distance between the central axis A1 of the male rotor 2 and the central axis A2 of the female rotor 3B is indicated by b, the grooves 70 are disposed within the distance of (a1+a2−b) from the pitch circle D2 of the female rotor 3B toward the central axis A2 of the female rotor 3B.

As illustrated in FIG. 13, the grooves 70 have a substantially constant depth. The grooves 70 are intended as a type of dynamic pressure groove the details of which are to be described later. The depth of the grooves 70 as dynamic pressure grooves has an appropriate value depending on the magnitude of a shear force that acts on the oil that has flowed into the grooves 70 and the magnitude of a centrifugal force to be described later. For example, providing the delivery-end-face clearance G1 is in the range from about several tens to 200 μm, the grooves 70 should preferably have a depth in the range from 1 μm to 1 mm.

Figure 14:
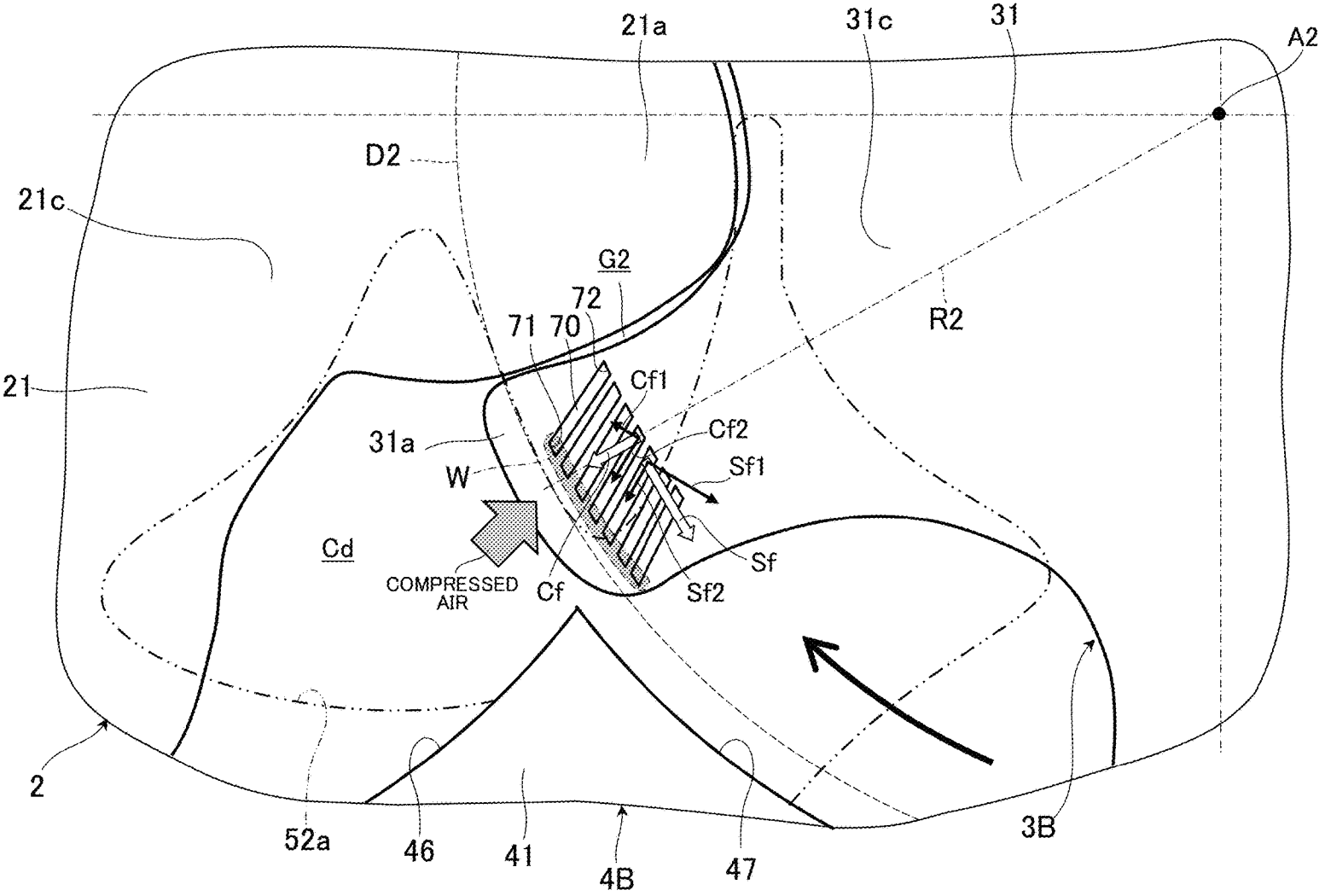
FIG. 14 is a view illustrating the manner in which the groove structure of the screw rotor of the screw compressor according to the second embodiment of the present invention operates.

Next, operation and advantages of the groove structure of the female rotor in the screw compressor according to the second embodiment will be described below with reference to FIGS. 13 and 14. FIG. 14 is a view illustrating the manner in which the groove structure of the screw rotor of the screw compressor according to the second embodiment of the present invention operates. In FIG. 13, the thick-line arrows represent a flow of oil. In FIG. 14, the two-dot-and-dash line represents the shape of the contour of the delivery port on the delivery inner wall face of the casing as projected onto the delivery end faces of the male and female rotors.

In the screw compressor 1B according to the present embodiment, mainly two kinds of forces act against the oil that has flowed into each of the grooves 70 formed on the delivery end face 31*c* of the female rotor 3B, unlike the cases of the first embodiment and the modification thereof. The first force is a centrifugal force Cf produced when the oil in the groove 70 rotates with the female rotor 3B, as depicted in FIG. 14. The centrifugal force Cf acts in the radial direction R2 perpendicular to the rotational direction of the female rotor 3B and toward the outer circumferential side. The second force is a shear force Sf produced when the oil in each of the groove 70 rotating with the female rotor 3B is dragged by the delivery inner wall face 49 (see FIG. 13) of the casing 4B. The shear force Sf acts in a direction tangential to the rotational direction of the female rotor 3B (a direction perpendicular to the radial direction R2 of the female rotor 3B) and toward a direction opposite to the rotational direction thereof.

The centrifugal force Cf acting against the oil in the groove 70 can be resolved into a first component force Cf1 that is a component force in a direction perpendicular to the longitudinal direction of the groove 70 and a second component force Cf2 that is a component force in the longitudinal direction of the groove 70. Similarly, the shear force Sf acting on the oil in the groove 70 can be resolved into a first component force Sf1 that is a component force in a direction perpendicular to the longitudinal direction of the groove 70 and a second component force Sf2 that is a component force in the longitudinal direction of the groove 70.

In the present embodiment, each of the grooves 70 extends so as to be inclined at the other end 72 as a base point with respect to the radial directions R2 of the female rotor 3B in the direction opposite to the rotational direction of the female rotor 3B. The second component forces Cf2 and Sf2 of the centrifugal force Cf and the shear force Sf thus become forces oriented toward the outer circumferential side of the female rotor 3B in the longitudinal direction of the grooves 70. Therefore, the oil in each of the grooves 70 is caused to flow toward the outer circumferential side of the female rotor 3B along the longitudinal direction of the groove 70 by the second component forces Cf2 and Sf2 of the centrifugal force Cf and the shear force Sf. As illustrated in FIGS. 13 and 14, the oil flowing in the groove 70 is dammed at the one end 71 as the end on the outer circumferential side of the female rotor 3B in the longitudinal direction of the groove 70, thereby its kinetic energy (dynamic pressure) is converted to cause a static pressure buildup. Then, the oil finally flows out into the delivery-end-face clearance G1 (toward the delivery inner wall face 49 of the casing 4B) in the region of the one end 71. Accordingly, the pressure of oil in the delivery-end-face clearance G1 becomes highest in the vicinity of the one end 71 of the groove 70.

Moreover, in the present embodiment, as illustrated in FIG. 14, the grooves 70 are juxtaposed such that their sides extending in the longitudinal directions are disposed adjacent to each other. Consequently, the pressurized oil flows out of the one end 71 (the end on the outer circumferential side of the female rotor) of each of the grooves 70 into the delivery-end-face clearance G1. The respective flows of high-pressure oil that have flowed out of the one ends 71 of the grooves 70 are joined together, promoting the formation of a high-pressure oil film W along the one ends 71 of the grooves 70 in the delivery-end-face clearance G1. The closer the one ends 71 of the grooves 70 are positioned to the outer circumferential side of the female rotor 3B, the larger the centrifugal force Cf and the shear force Sf acting against the oil become upon rotation of the female rotor 3B, resulting in a corresponding increase in the ability of the oil film W to restrain an internal leak due to the pressure buildup.

In the present embodiment, the grooves 70 are disposed within the distance of (a1+a2−b) from the pitch circle D2 of the female rotor 3B toward the central axis A2 of the female rotor 3B. This allows the one ends 71 of the grooves 70 to exist in a position between the working chamber in the delivery process and the axial fluid communication chamber G2 at a certain rotational position of the female rotor 3B.

Consequently, not only the oil in the grooves 70 of the female rotor 3B seals the delivery-end-face clearance G1, but also the oil that has flowed out of the grooves 70 forms the oil film W that is higher in pressure than in the peripheral region. While the axial fluid communication path G2 is overlapping the shield area 49*a* with the delivery-end-face clearance G1 interposed therebetween, the high-pressure oil film W prevents the compressed air in the delivery fluid passage 52 (see FIG. 1) and the working chamber Cd in the delivery process (high pressure space) from leaking from the lobe tip of the female rotor 3B via the axial fluid communication path G2 into the working chamber in the suction process (low pressure space). The oil behavior described above makes it possible to increase the compression performance and energy-saving performance of the screw compressor 1B.

As described above, the grooves 70 formed on the delivery end face 31*c* of the female rotor 3B dam at the one ends 71 the oil that flows under the shear force Sf and the centrifugal force Cf, thereby forming the high-pressure oil film W through conversion of a dynamic pressure of the oil into a static pressure. The grooves 70 can be referred to as a type of dynamic pressure groove. The depth of each of the grooves 70 can be set to an appropriate value (e.g., in the range from 1 μm to 1 mm) capable of maximizing the pressure of the oil film W, depending on the magnitudes of the shear force Sf and the centrifugal force Cf acting against the oil and the size of the delivery-end-face clearance G1, thereby further restraining an internal leak via the axial fluid communication path G2.

Furthermore, in the present embodiment, the grooves 70 are disposed within the pitch circle D2 of the female rotor 3B and disposed to be short of the contour line of the female rotor 3B. This prevents the grooves 70 from simultaneously communicating with the working chamber Cd in the delivery process and the axial fluid communication path G2 to become routes for an internal leak.

Moreover, in the present embodiment, the grooves 70 can be formed on the delivery end face 31*c* of the female rotor 3B, which has been formed by casting or the like, through a machining process such as a cutting process. It is thus easy to work in the process of manufacturing the compressor.

Modification of Second Embodiment

Figure 15:
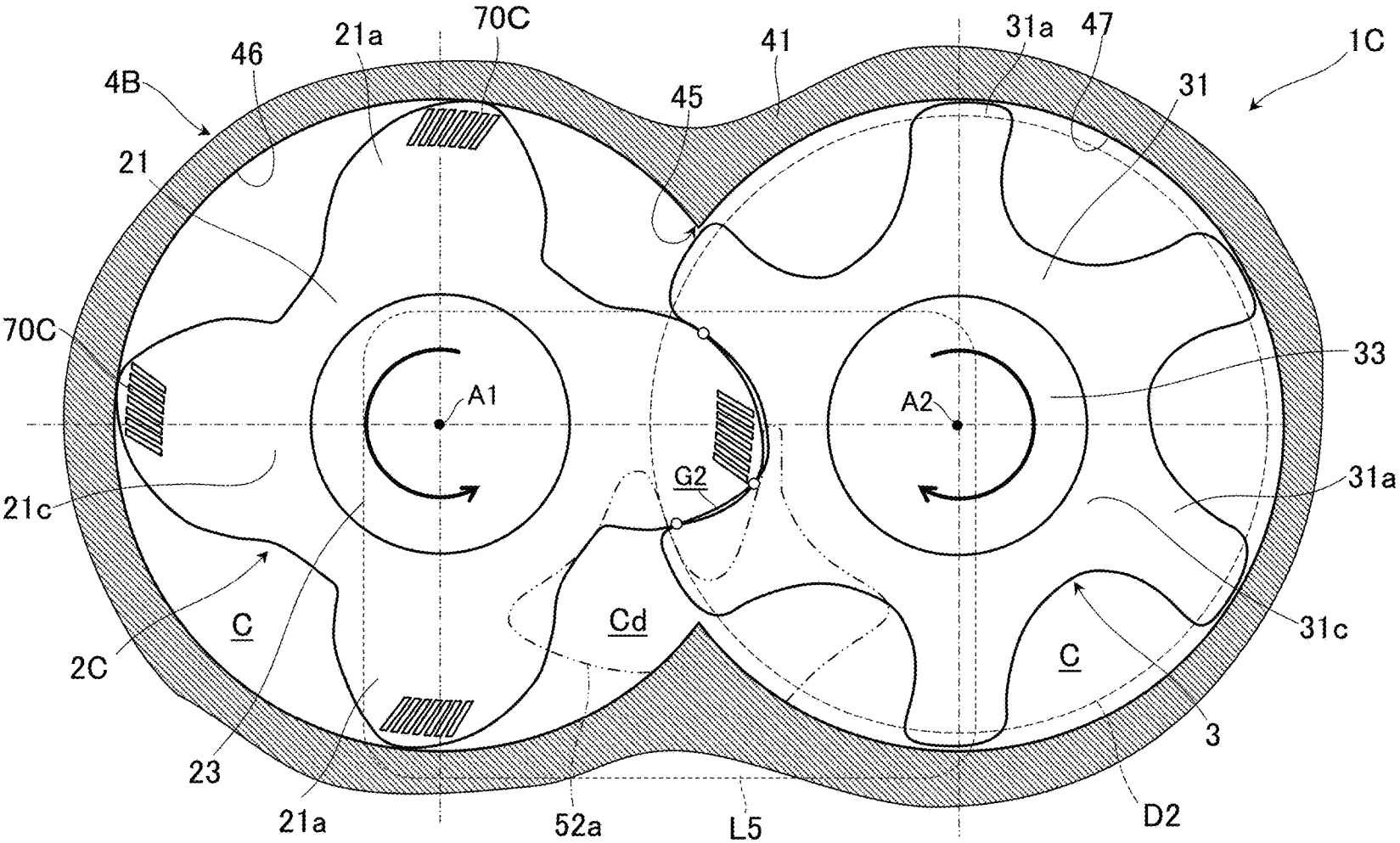
FIG. 15 is a cross-sectional view of a screw compressor according to a modification of the second embodiment of the present invention, taken along the same line as FIG. 2.
Figure 16:
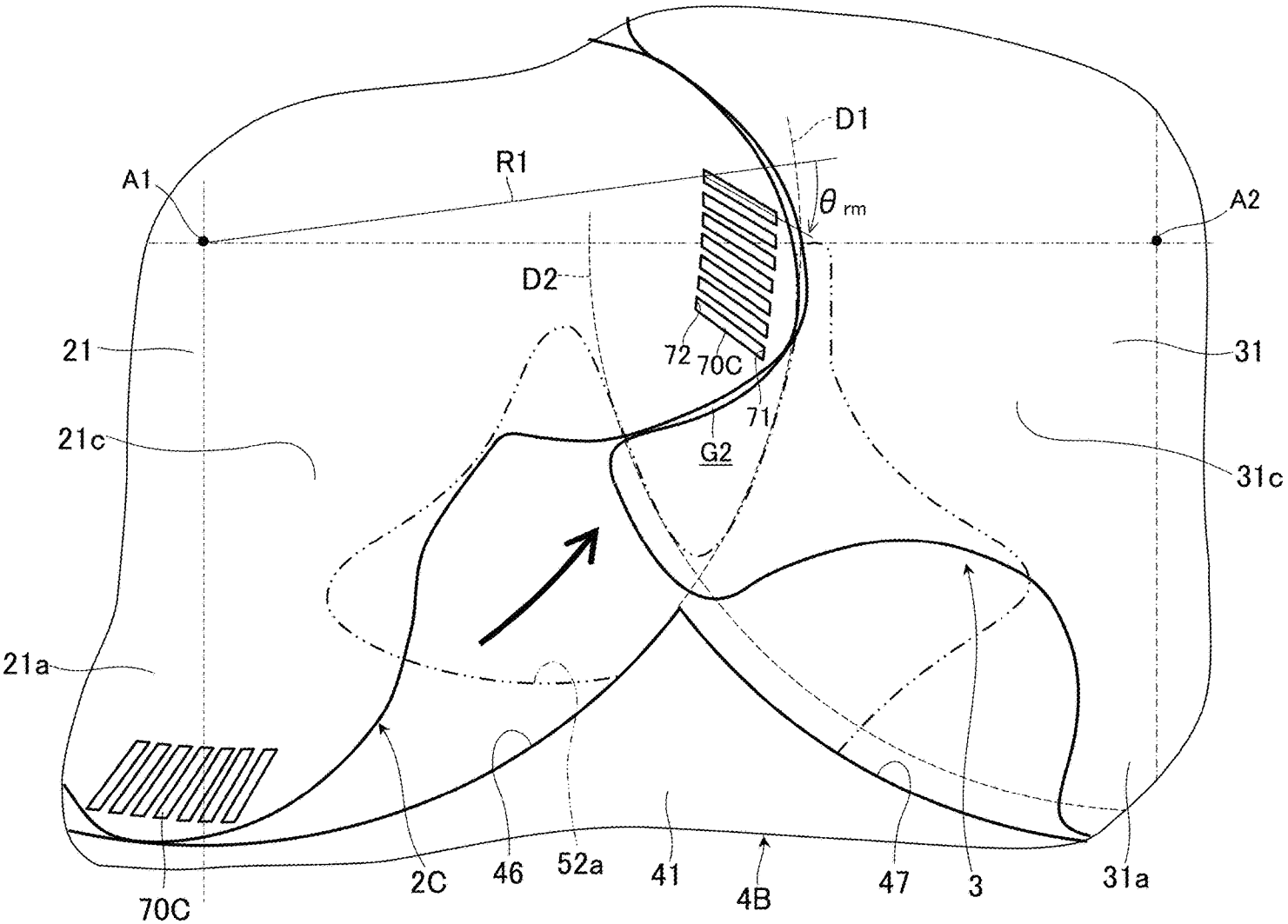
FIG. 16 is an enlarged view of a section of FIG. 15 that is indicated by the sign L5, the view illustrating a groove structure of a screw rotor of the screw compressor according to the modification of the second embodiment of the present invention.
Figure 17:
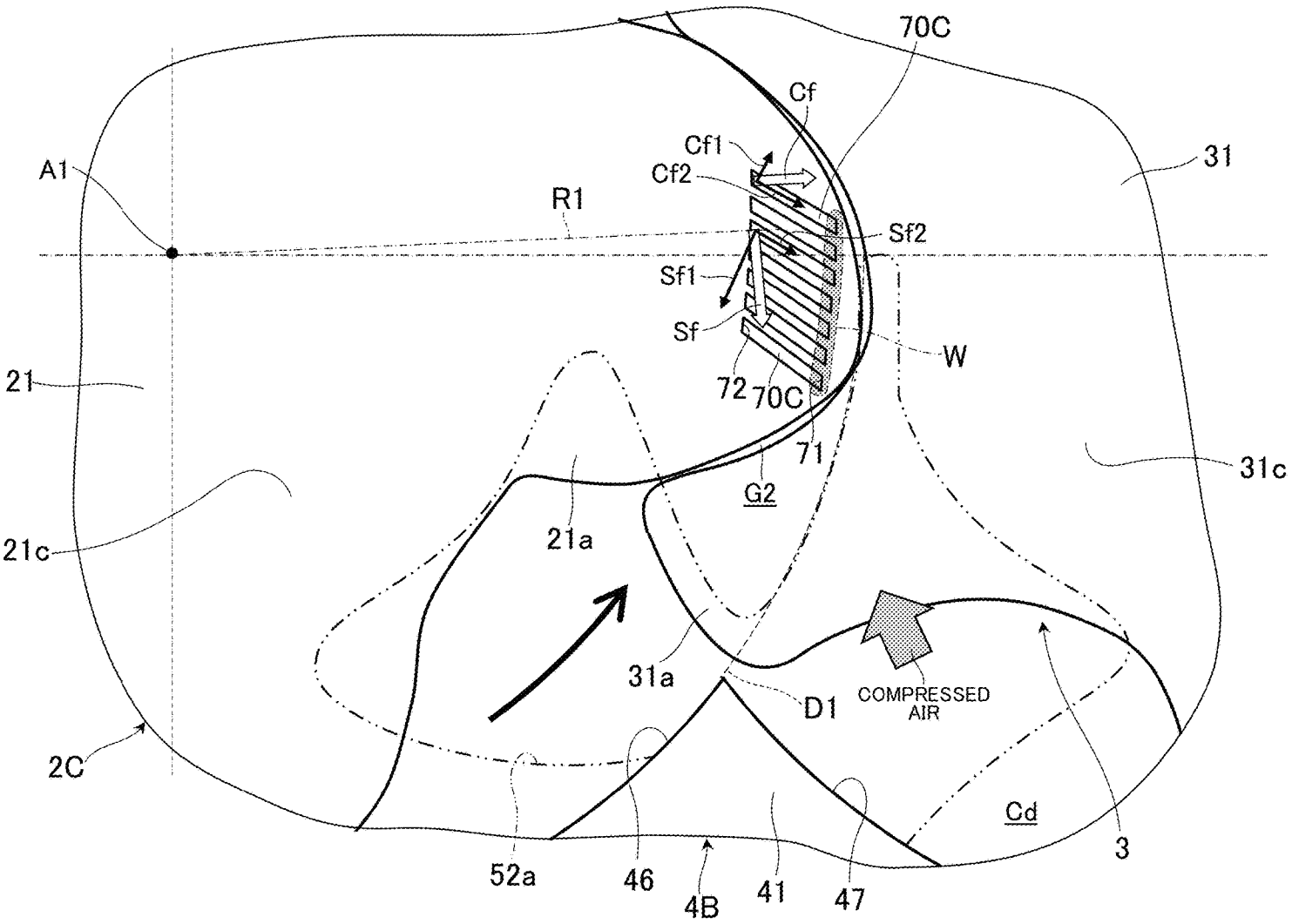
FIG. 17 is a view illustrating the manner in which the groove structure of the screw rotor of the screw compressor according to the modification of the second embodiment of the present invention operates.

A screw compressor according to a modification of the second embodiment will be described by way of example below with reference to FIGS. 15 through 17. FIG. 15 is a cross-sectional view of the screw compressor according to the modification of the second embodiment of the present invention, taken along the same line as FIG. 2. FIG. 16 is an enlarged view of a section of FIG. 15 that is indicated by the sign L5, the view illustrating a groove structure of a screw rotor of the screw compressor according to the modification of the second embodiment of the present invention. FIG. 17 is a view illustrating the manner in which the groove structure of the screw rotor of the screw compressor according to the modification of the second embodiment of the present invention operates. In FIGS. 15 and 16, the two-dot-and-dash line represents the shape of the contour of the delivery port on the delivery inner wall face of the casing as projected onto the delivery end faces of the male and female rotors, and the thick-line arrows represent the rotational directions of the rotors. In FIG. 15, an outer periphery side of the casing is omitted from illustration. In FIGS. 15 through 17, those parts denoted by the same characters as those illustrated in FIGS. 1 through 14 are similar parts and will be omitted from detailed description.

The screw compressor 1C, illustrated in FIGS. 15 and 16, according to the modification of the second embodiment is different from that in the second embodiment in that a groove structure for forming a high-pressure oil film W is provided not on the delivery end face 31*c* of the female rotor 3 but on the delivery end face 21*c* of a male rotor 2C.

Specifically, a tip area of each male lobe 21*a* on the delivery end face 21*c* of the male rotor 2C is provided with a groove group made up of a plurality of grooves 70C. The grooves 70C are juxtaposed in a thickness direction of each male lobe 21*a*. In other words, the grooves 70C are juxtaposed circumferentially around the central axis A1 of the male rotor 2C. Each of the grooves 70C is shaped as a an elongated groove having a longitudinal direction. The grooves 70C are arranged such that their sides extending in the longitudinal directions are disposed adjacent to each other.

As illustrated in FIG. 16, each of the grooves 70C has one end 71 in the longitudinal direction positioned on an outer circumferential side of the male rotor 2C compared to the other end 72, and extends straight from the other end 72 (the end on the inner circumferential side) toward the one end 71 (the end on the outer circumferential side), for example. The grooves 70C are configured such that their longitudinal directions oriented from the other end 72 (the end on the inner circumferential side) toward the one end 71 (the end on the outer circumferential side) are inclined at an angle θrm with respect to the radial direction R1 of the male rotor 2C in a direction opposite to the rotational direction of the male rotor 2C. The grooves 70C are restricted to a position inside of the tip circle D1 of the male rotor 2C and a position short of the contour line of the male lobes 21*a* of the male rotor 2C.

As is the case with the second embodiment, providing the distance from the central axis A1 of the male rotor 2C to the tip circle D1 of the male rotor 2C is indicated by a1, the distance from the central axis A2 of the female rotor 3 to the pitch circle D2 of the female rotor 3 is indicated by a2, and the distance between the central axis A1 of the male rotor 2C and the central axis A2 of the female rotor 3 is indicated by b (see FIG. 12), the grooves 70C are disposed within the distance of (a1+a2−b) from the tip circle D1 of the male rotor 2C toward the central axis A1 of the male rotor 2C. This allows the one ends 71 of the grooves 70C to exist in a position between the working chamber Cd in the delivery process and the axial fluid communication chamber G2 at a certain rotational position of the male rotor 2C.

In the present modification, two kinds of forces including a centrifugal force Cf and a shear force Sf act against the oil that has flowed into each of the grooves 70C formed on the delivery end face 21*c* of the male rotor 2C, as is the case with the second embodiment. The centrifugal force Cf acts in the radial direction R1 perpendicular to the rotational direction of the male rotor 2C and toward the outer circumferential side. The shear force Sf acts in a direction tangential to the rotational direction of the male rotor 2C (a direction perpendicular to the radial direction R1 of the male rotor 2C) and toward a direction opposite to the rotational direction thereof. The centrifugal force Cf acting against the oil in the groove 70C can be resolved into a first component force Cf1 that is a component force in a direction perpendicular to the longitudinal direction of the groove 70C and a second component force Cf2 that is a component force in the longitudinal direction of the groove 70C. Similarly, the shear force Sf acting on the oil in the groove 70C can be resolved into a first component force Sf1 that is a component force in the direction perpendicular to the longitudinal direction of the groove 70C and a second component force Sf2 that is a component force in the longitudinal direction of the groove 70C.

In the present modification, as illustrated in FIG. 16, each of the grooves 70C extends so as to be inclined at the other end 72 as a base point with respect to the radial directions R1 of the male rotor 2C in the direction opposite to the rotational direction of the male rotor 2C. The second component forces Cf2 and Sf2 of the centrifugal force Cf and the shear force Sf thus become forces oriented toward the outer circumferential side of the male rotor 2C in the longitudinal direction of the grooves 70C. Therefore, the oil in each of the grooves 70C is caused to flow toward the outer circumferential side of the male rotor 2C along the longitudinal direction of the groove 70C by the second component forces Cf2 and Sf2 of the centrifugal force Cf and the shear force Sf. The oil flowing in the groove 70C is dammed at the one end 71 as the end on the outer circumferential side of the male rotor 2C in the longitudinal direction of the groove 70C, its kinetic energy (dynamic pressure) is thereby converted to cause a static pressure buildup. Then, the oil finally flows out into the delivery-end-face clearance G1 (toward the delivery inner wall face 49 of the casing 4B) in the region of the one end 71. Accordingly, the pressure of oil in the delivery-end-face clearance G1 becomes highest in the vicinity of the one end 71 of the groove 70C.

In the present modification, as illustrated in FIG. 16, the grooves 70C are juxtaposed such that their sides extending in the longitudinal directions are disposed adjacent to each other. Consequently, the pressurized oil flows out of the one end 71 (the end on the outer circumferential side of the male rotor) of each of the grooves 70C into the delivery-end-face clearance G1. The respective flows of high-pressure oil that have flowed out of the one ends 71 are joined together, promoting the formation of a high-pressure oil film W along the one ends 71 of the grooves 70C in the delivery-end-face clearance G1. The grooves 70C dam at the one ends 71 the oil that flows under the shear force Sf and the centrifugal force Cf, thereby forming the high-pressure oil film W through conversion of a dynamic pressure of the oil to a static pressure. The grooves 70C can be referred to as a type of dynamic pressure groove. The closer the one ends 71 of the grooves 70C are positioned to the outer circumferential side of the male rotor 2C, the larger the centrifugal force Cf and the shear force Sf acting against the oil become upon rotation of the male rotor 2C, resulting in a corresponding increase in the ability of the oil film W to restrain an internal leak due to the pressure buildup.

In this way, not only the oil in the grooves 70C of the male rotor 2C seals the delivery-end-face clearance G1, but also the oil that has flowed out of the grooves 70C of the male rotor 2C forms the oil film W that is higher in pressure than in the peripheral region. While the axial fluid communication path G2 is overlapping the shield area 49*a* with the delivery-end-face clearance G1 interposed therebetween, the high-pressure oil film W prevents the compressed air in the delivery fluid passage 52 (see FIG. 1) and the working chamber Cd in the delivery process (high pressure space) from leaking from the edge of the shield area 49*a* near the female rotor 3 via the axial fluid communication path G2 into the working chamber in the suction process (low pressure space). The oil behavior described above makes it possible to increase the compression performance and energy-saving performance of the screw compressor 1C.

Furthermore, in the present modification, the grooves 70C are disposed within the tip circle D1 of the male rotor 2C and disposed to be short of the contour line of the male rotor 2C. This prevents the grooves 70C from simultaneously communicating with the working chamber Cd in the delivery process and the axial fluid communication path G2 to become routes for an internal leak.

In the present modification, the grooves 70C can be formed on the delivery end face 21*c* of the male rotor 2C, which has been formed by casting or the like, through a machining process such as a cutting process. It is thus easy to work in the process of manufacturing the compressor.

The second embodiment and the modification thereof as described above are summarized as follows: The screw compressor 1B, 1C according to the second embodiment and the modification thereof includes the male rotor 2, 2C having the first delivery end face 21*c* on one side in the axial direction thereof and rotatable about the first central axis A1, the female rotor 3, 3B having the second delivery end face 31*c* on one side in the axial direction thereof and rotatable about the second central axis A1, and the casing 4B having the housing chamber 45 in which the male rotor 2, 2C and the female rotors 3, 3B are rotatably housed in a mutually meshed state. The delivery end face 21*c*, 31*c* of at least one rotor of the male rotor 2C and the female rotor 3B is provided with the groove group made up of the grooves 70, 70C having the longitudinal directions. The grooves 70, 70C of the groove group are juxtaposed in the circumferential direction of the one rotor (the male rotor 2C or the female rotor 3B) and are arranged such that their sides extending in the longitudinal directions are disposed adjacent to each other.

With this configuration, the oil (liquid) in the grooves 70, 70C provided on the delivery end face 21*c*, 31*c* of the one rotor (the male rotor 2C or the female rotor 3B) is caused to flow in the longitudinal directions by the centrifugal force and the shear force and then dammed, resulting in a pressure buildup. This allows the high-pressure oil film W (liquid film) to be formed in the vicinity of the axial fluid communication path G2 in the delivery-end-face clearance G1. Therefore, it is possible to reduce an internal leak of compressed gas via the axial fluid communication path G2.

Figure 18A:
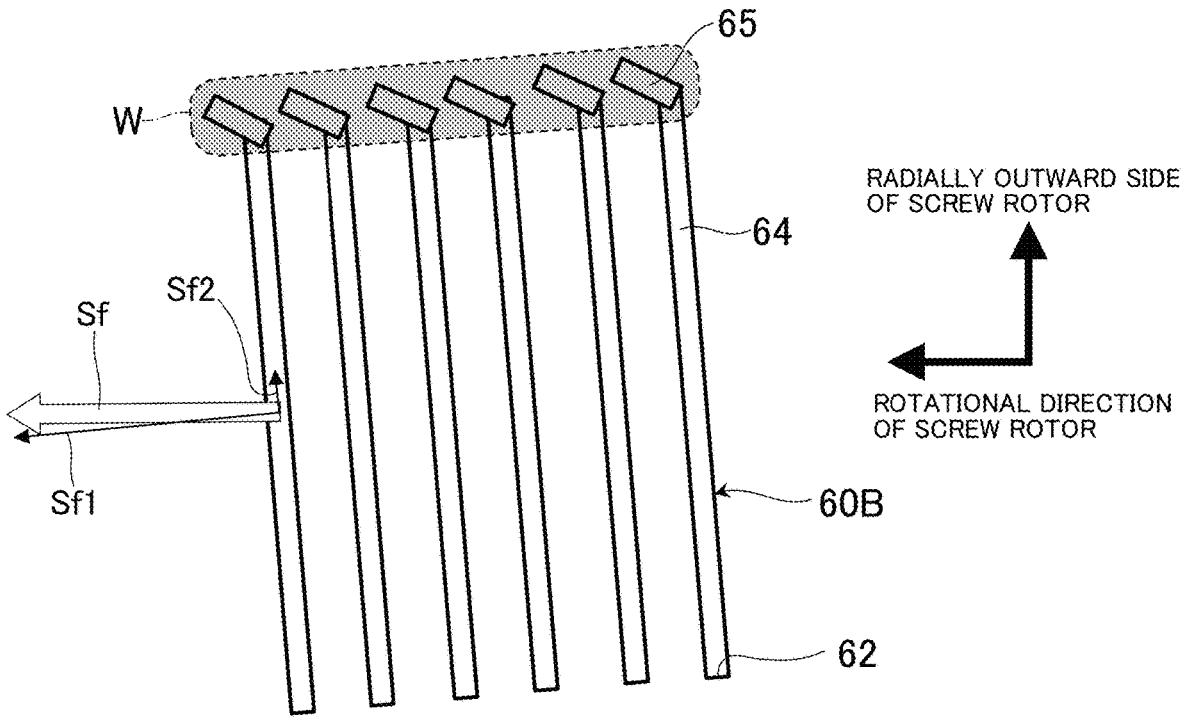
FIG. 18A is a view illustrating a first example of variation of the groove structures of the casings of the screw compressors according to the first embodiment of the present invention and the modification thereof.
Figure 18B:
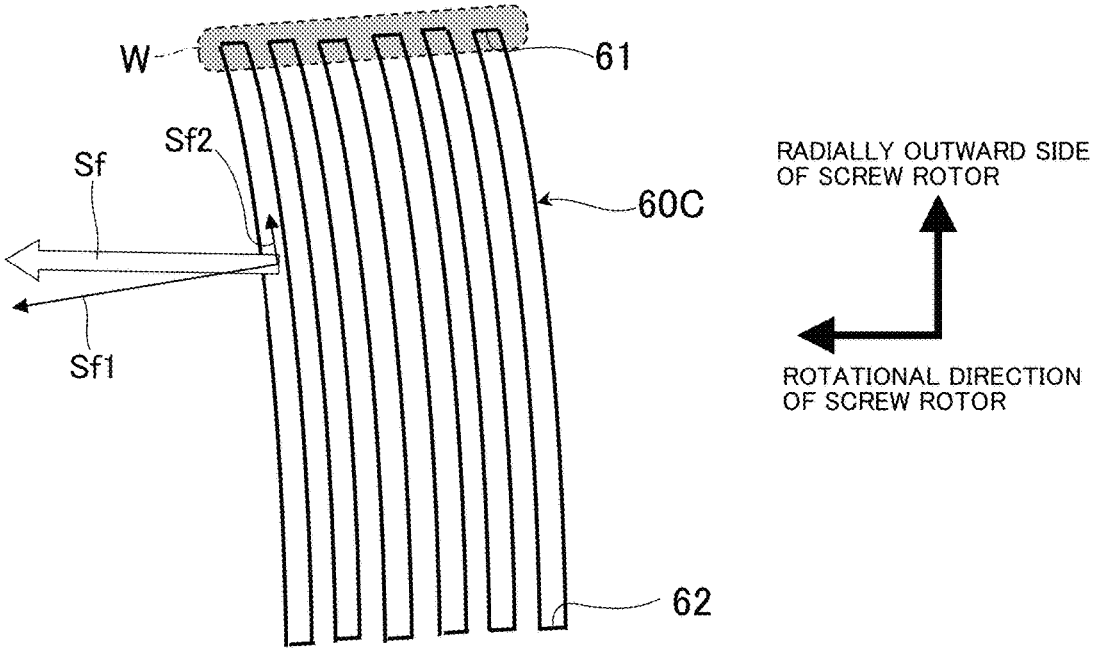
FIG. 18B is a view illustrating a second example of variation of the groove structures of the casings of the screw compressors according to the first embodiment of the present invention and the modification thereof.
Figure 18C:
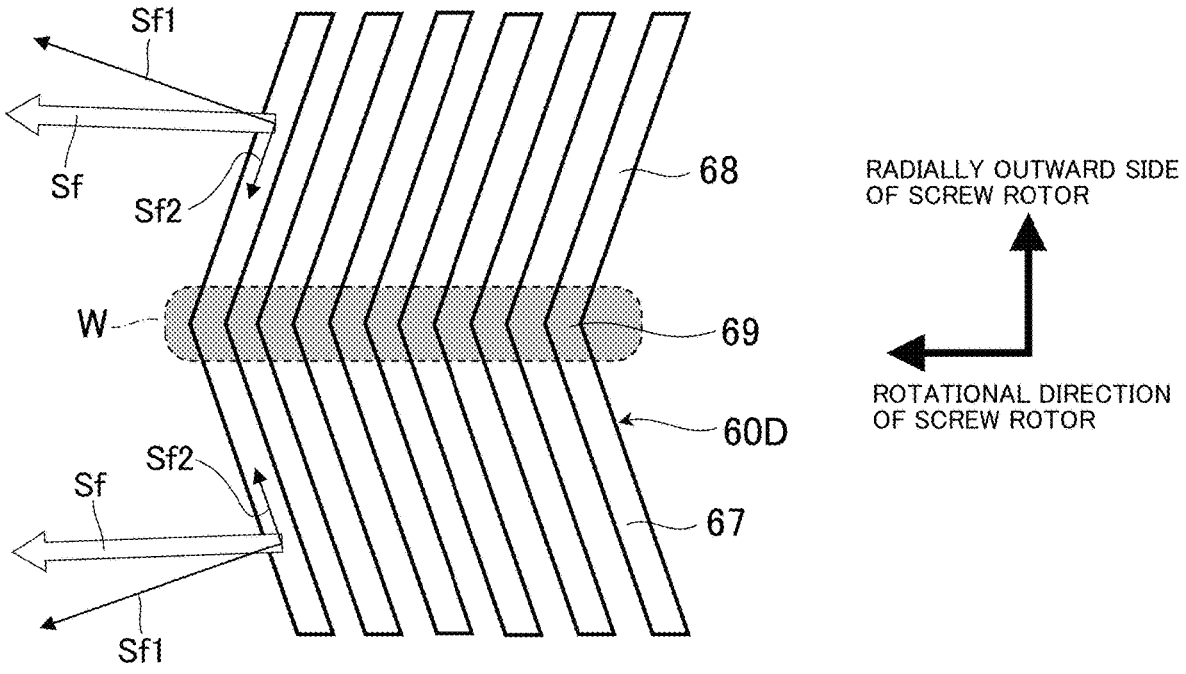
FIG. 18C is a view illustrating a third example of variation of the groove structures of the casings of the screw compressors according to the first embodiment of the present invention and the modification thereof.

Variations of Groove Structures According to First Embodiment and Modification Thereof Variations of the groove structures of the casings in the screw compressors according to the first embodiment and the modification thereof will be described by way of example below with reference to FIGS. 18A through 18C. FIGS. 18A, 18B, and 18C are views illustrating first, second, and third examples of variation of the groove structures of the casings in the screw compressors according to the first embodiment of the present invention and the modification thereof. In FIGS. 18A through 18C, the upward direction represents a radially outward side (an outer circumferential side) of a screw rotor in question (male rotor or female rotor), and the leftward direction represents the rotational direction of the screw rotor in question.

The groove structure (groove group) formed on the delivery inner wall face 49 of the casing 4, 4A in the screw compressor 1, 1A according to the first embodiment and the modification thereof may adopt a number of variations other than the grooves 60, 60A described above. A groove structure (groove group) may, on principle, be such a structure that is capable of damming, at some position in grooves, the oil that flows in the grooves due to a shear force produced upon rotation of the screw rotor in question. In other words, the groove structure (groove group) may be such a structure that is capable of functioning as dynamic pressure grooves.

The first example of variation of the groove structure (groove group) includes grooves 60B that are each a combination of a groove body 64, which is linearly formed and has a longitudinal direction, and an additional groove portion 65, which is connected to the groove body 64 and has a different shape from the groove body 64, as illustrated in FIG. 18A. As with the grooves 60, 60A according to the first embodiment and the modification thereof, the groove body 64 is configured such that its longitudinal direction is inclined at the other end 62 of the groove 60B as a base point with respect to the radial direction of the screw rotor in question (the male rotor 2 or the female rotor 3) in the same direction as the rotational direction of the screw rotor. Therefore, as with the grooves 60, 60A according to the first embodiment and the modification thereof, the second component force Sf2 of the shear force Sf acts on the oil in the groove body 64 toward the outer circumferential side of the groove body 64 along the longitudinal direction of the groove body 64. The additional groove portion 65 is a short groove portion that is connected to the end of the groove body 64 on the outer circumferential side and that has a larger inclination angle than the groove body 64, for example. The shape and position of the additional groove portion 65 may be selected to prompt the formation and the pressure buildup of the oil film W, or the introduction of oil into the groove 60B.

As is the case with the first embodiment and the modification thereof, the oil in each of the grooves 60B according to the first example of variation is caused to flow toward the additional groove portion 65 as the outer circumferential end of the groove 60B by the shear force Sf, and is dammed at the additional groove portion 65, resulting in an increase in the static pressure of the oil. Finally, the pressurized oil flows out of the outer circumferential ends of the grooves 60B (the additional groove portions 65) into the delivery-end-face clearance G1 (toward the screw rotor), and the flows of the oil from the grooves 60B are joined together, thereby forming a high-pressure oil film W along the additional groove portions 65 of the grooves 60B in the delivery-end-face clearance G1.

In the second example of variation of the groove structure (groove group) illustrated in FIG. 18B, each groove 60C is not straight, but curved. The curved shape of the groove 60C is configured such that a line tangential to each point on the groove 60C is inclined with respect to the radial directions of the screw rotor in question (the male rotor 2 or the female rotor 3) in the same direction as the rotational direction of the screw rotor in question. As with the grooves 60, 60A according to the first embodiment and the modification thereof, the second component force Sf2 of the shear force Sf acts on the oil in the groove 60C toward the outer circumferential side of the groove 60C.

Consequently, as is the case with the first embodiment and the modification thereof, the oil in each of the grooves 60C according to the second example of variation is caused to flow toward the one end (the end on the outer circumferential side) 61 of the groove 60C by the second component force Sf2 of the shear force Sf, and is dammed at the one end 61, resulting in an increase in the static pressure of the oil. Finally, the pressurized oil flows out of the one ends 61 of the grooves 60C into the delivery-end-face clearance G1 (toward the screw rotor), and the flows of the oil from the grooves 60C are joined together, thereby forming a high-pressure oil film W along the one ends 61 of the grooves 60C in the delivery-end-face clearance G1.

In the third example of variation of the groove structure (groove group) illustrated in FIG. 18C, each groove 60D is formed in a V-shape and the grooves 60D are juxtaposed in a herringbone pattern in the circumferential direction of the screw rotor in question (the male rotor 2 or the female rotor 3). Each of the grooves 60D is formed such that the V-shape opens in the direction opposite to the rotational direction of the screw rotor in question.

Specifically, each of the grooves 60D includes a first groove portion 67 that is one side of the V shape and a second groove portion 68 that is the other side of the V shape positioned on the radially outward side of the screw rotor in question as compared to the first groove portion 67. The first groove portion 67 is inclined with respect to the radial direction of the screw rotor in question in the same direction as the rotational direction of the screw rotor, whereas the second groove portion 68 is inclined with respect to the radial direction of the screw rotor in question in the direction opposite to the rotational direction of the screw rotor. Further, each of the grooves 60D is configured such that a joint 69 (a corner of the V shape) between the first groove portion 67 and the second groove portion 68 is positioned between the axial fluid communication path G2 and the working chamber Cd in the delivery process at the certain rotational position of the screw rotor in question.

As with the grooves 60, 60A according to the first embodiment and the modification thereof, the second component force Sf2 of the shear force Sf acts on the oil in the first groove portion 67 toward the outer circumferential side of the first groove portion 67. On the other hand, unlike the grooves 60, 60A according to the first embodiment and the modification thereof, the second component force Sf2 of the shear force Sf acts on the oil in the second groove portion 68 toward the inner circumferential side of the second groove portion 68.

In each of the grooves 60D according to the third example of variation, therefore, the oil in the first groove portion 67 is caused to flow toward the joint 69 (the corner of the V-shaped groove 60D) between the first groove portion 67 and the second groove portion 68 by the second component force Sf2 of the shear force Sf, and the oil in the second groove portion 68 is caused to flow toward the joint 69 by the second component force Sf2 of the shear force Sf. The oil flowing in the first groove portion 67 and the oil flowing in the second groove portion 68 are joined together and dam each other, and thereby their dynamic pressure is converted to cause a static pressure buildup. The pressurized oil finally flows out of the joints 69 of the grooves 60D (the corners of the V-shaped grooves 60) into the delivery-end-face clearance G1 (toward the screw rotor). The respective flows of high-pressure oil that have flowed out of the joints 69 are joined together, forming a high-pressure oil film W along the joints 69 (the corners) of the grooves 60D in the delivery-end-face clearance G1.

According to the first through third examples of variation of the groove structure (groove group) of the casing, as described above, the oil in the grooves 60B, 60C, 60D is caused to flow by the action of the shear force Sf upon rotation of the screw rotor and is then dammed, thereby resulting in a pressure buildup of the oil. The pressurized oil then flows out into the delivery-end-face clearance G1. Therefore, as with the groove structures according to the first embodiment and the modification thereof, it is possible to form the high-pressure oil film W between the axial fluid communication path G2 and the working chamber Cd in the delivery process (high-pressure space), and restrain an internal leak via the axial fluid communication path G2.

The screw compressor according to the third example of variation has a feature that the grooves 60D of the groove group are formed in a V-shape and juxtaposed in a herringbone pattern in the circumferential direction of one rotor (the male rotor 2 or the female rotor 3), and that each of the grooves 60D of the groove group is configured such that the V-shape opens in the opposite direction to the rotational direction of the one rotor (the male rotor 2 or the female rotor 3).

Variations of Groove Structures According to Second Embodiment and Modification Thereof Variations of the groove structures of the screw rotors of the screw compressors according to the second embodiment and the modification thereof will be described by way of example below with reference to FIGS. 19A through 19F. FIGS. 19A, 19B, 19C, 19D, 19E, and 19F are views illustrating first, second, third, fourth, fifth, and sixth examples of variation of the groove structures of the screw rotors of the screw compressors according to the second embodiment of the present invention and the modification thereof. In FIGS. 19A through 19F, the upward direction represents the radially outward side (toward the outer circumferential side) of a screw rotor in question (male rotor or female rotor), and the leftward direction represents the rotational direction of the screw rotor in question.

The groove structure (groove group) formed on the delivery end face 21*c*, 31*c* of the screw rotor (the male rotor 2C or the female rotor 3B) in the screw compressors 1B, 1C according to the second embodiment and the modification thereof may adopt a number of variations other than the grooves 70, 70C described above. A groove structure (groove group) may, on principle, be such a structure that is capable of damming, at some position in grooves, the oil that flows in the grooves due to a centrifugal force or a shear force produced upon rotation of the screw rotor in question. In other words, the groove structure (groove group) may be such a structure that is capable of functioning as dynamic pressure grooves.

Figure 19A:
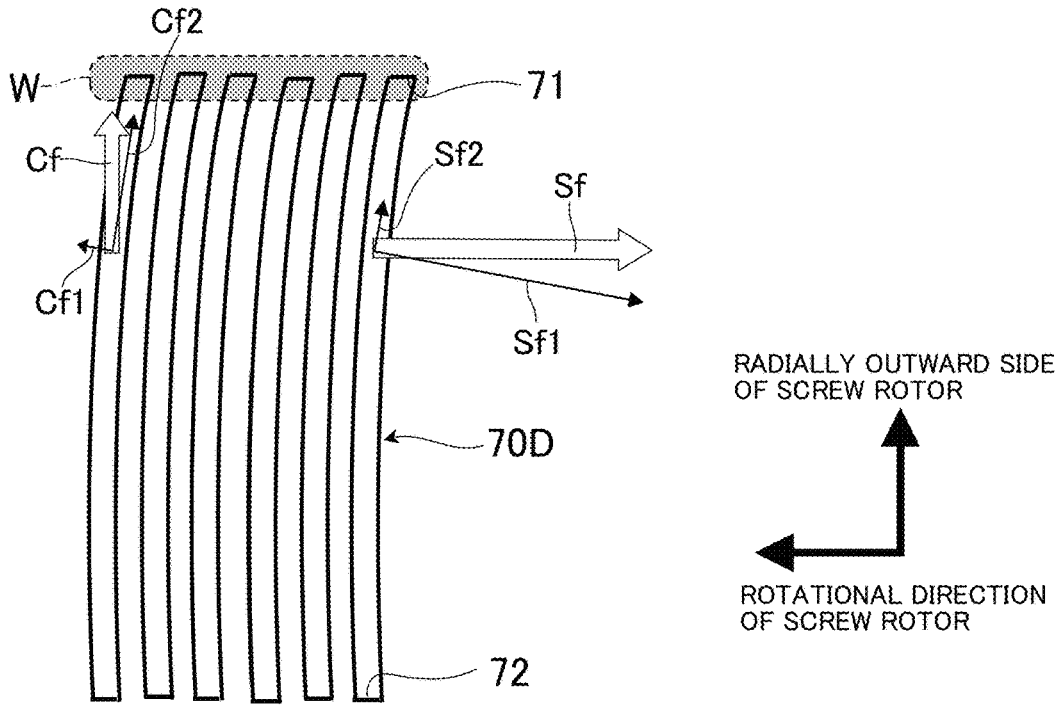
FIG. 19A is a view illustrating a first example of variation of the groove structures of the screw rotors of the screw compressors according to the second embodiment of the present invention and the modification thereof.

In the first example of variation of the groove structure (groove group) illustrated in FIG. 19A, grooves 70D are each not straight, but curved. The curved shape of the groove 70D is configured such that a line tangential to each point on the groove 70D is inclined with respect to the radial direction of the screw rotor in question (the male rotor 2C or the female rotor 3B) in the direction opposite to the rotational direction of the screw rotor. As with the grooves 70, 70C according to the second embodiment and the modification thereof, the second component forces Cf2 and Sf2 of the centrifugal force Cf and the shear force Sf act against the oil in the groove 70D toward the outer circumferential side of the groove 70D.

Consequently, as is the case with the second embodiment and the modification thereof, the oil in each of the grooves 70D according to the first example of variation is caused to flow toward the one end (the end on the outer circumferential side) 71 of the groove 70D by the second component forces Cf2 and Sf2 of the centrifugal force Cf and the shear force Sf, and is dammed at the one end 71, resulting in an increase in the static pressure of the oil. Finally, the pressurized oil flows out of the one ends 71 of the grooves 70D into the delivery-end-face clearance G1 (toward the delivery inner wall face 49 of the casing 4B), and the flows of the oil from the grooves 70D are joined together, forming a high-pressure oil film W along the one ends 71 of the grooves 70D.

Figure 19B:
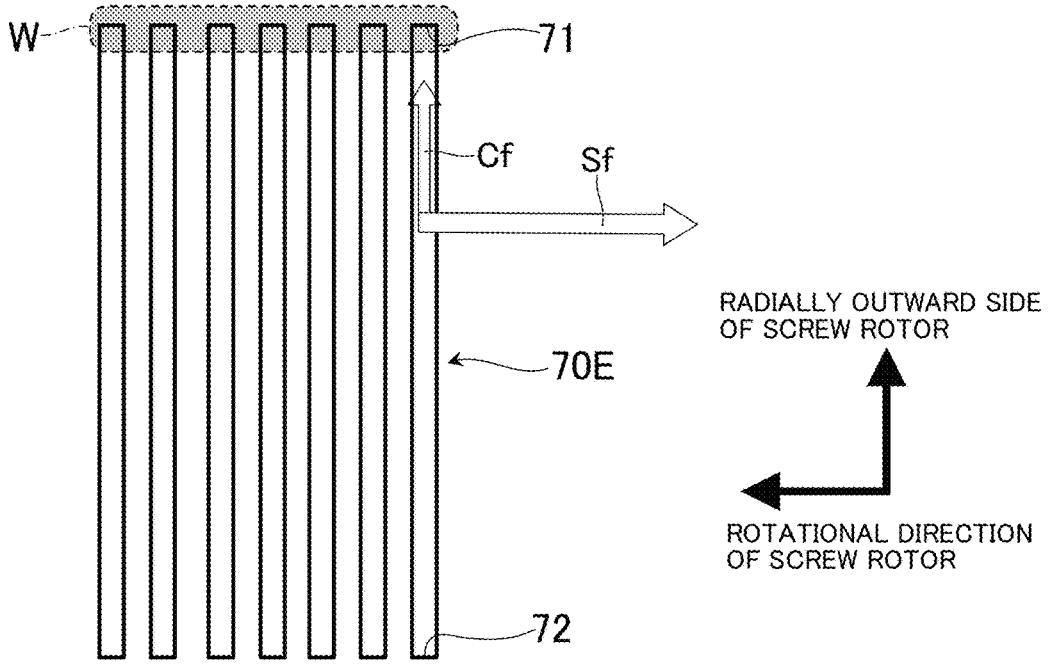
FIG. 19B is a view illustrating a second example of variation of the groove structures of the screw rotors of the screw compressors according to the second embodiment of the present invention and the modification thereof.

In the second example of variation of the groove structure (groove group) illustrated in FIG. 19B, grooves 70E each have a longitudinal direction extending straight along the radial direction of the screw rotor in question (the male rotor 2C or the female rotor 3B). Therefore, the centrifugal force Cf acting on the oil in the groove 70E has only a component in the longitudinal direction of the groove 70E. On the other hand, the shear force Sf acting on the oil in the groove 70E has no component in the longitudinal direction of the groove 70E, but has only a component in a direction perpendicular to the longitudinal direction of the groove 70E.

Consequently, the oil in each of the grooves 70E according to the second example of variation is caused to flow toward the one end (the end on the outer circumferential side) 71 of the groove 70E by the centrifugal force Cf, and is dammed at the one end 71, resulting in an increase in the static pressure of the oil. Finally, the pressurized oil flows out of the one ends 71 of the grooves 70E into the delivery-end-face clearance G1 (toward the delivery inner wall face 49 of the casing 4B), and the flows of the oil from the grooves 70E are joined together, forming a high-pressure oil film W along the one ends 71 of the grooves 70E.

Figure 19C:
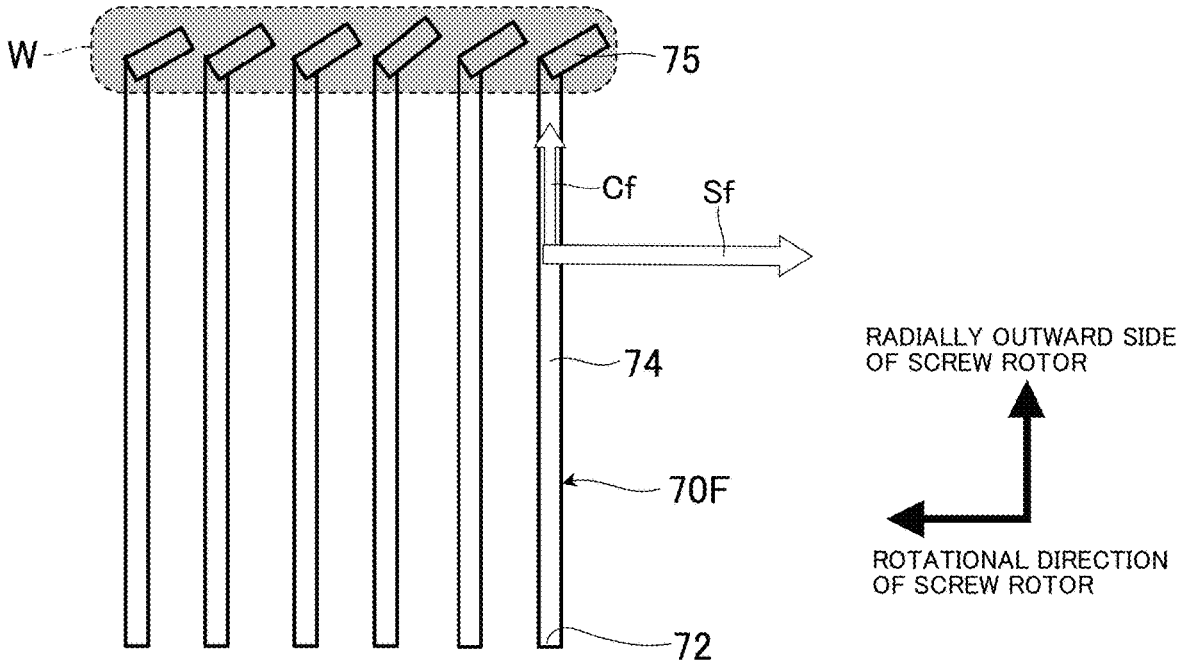
FIG. 19C is a view illustrating a third example of variation of the groove structures of the screw rotors of the screw compressors according to the second embodiment of the present invention and the modification thereof.

In the third example of variation of the groove structure (groove group) illustrated in FIG. 19C, grooves 70F are each a combination of a groove body 74, which is linearly formed and has a longitudinal direction, and an additional groove portion 75, which is connected to the groove body 74 and has a different shape from the groove body 74. As with the grooves 70E according to the second example of variation, the groove body 74 is configured such that its longitudinal direction extends straight along the radiation direction of the screw rotor in question (the male rotor 2C or the female rotor 3B). Therefore, as with the grooves 70E according to the second example of variation, the centrifugal force Cf acts against the oil in the groove body 74 toward the outer circumferential side of the groove body 74. The additional groove portion 75 is a short groove portion connected to the end of the groove body 74 on the outer circumferential side, for example. The shape and position of the additional groove portion 75 may be selected to prompt the formation and the pressure buildup of the oil film W, or the introduction of oil into the groove 70F.

Consequently, as is with the second example of variation, the oil in the groove body 74 of each of the grooves 70F according to the third example of variation is caused to flow toward the additional groove portion 75 as the end on the outer circumferential side of the groove 70F by the centrifugal force Cf, and is dammed at the additional groove portion 75, resulting in an increase in the static pressure of the oil. Finally, the pressurized oil flows out of the outer circumferential ends of the grooves 70F (the additional groove portions 75) into the delivery-end-face clearance G1 (toward the delivery inner wall face 49 of the casing 4B), and the flows of the oil from the grooves 70F are joined together, forming a high-pressure oil film W along the additional groove portions 75 of the grooves 70F.

Figure 19D:
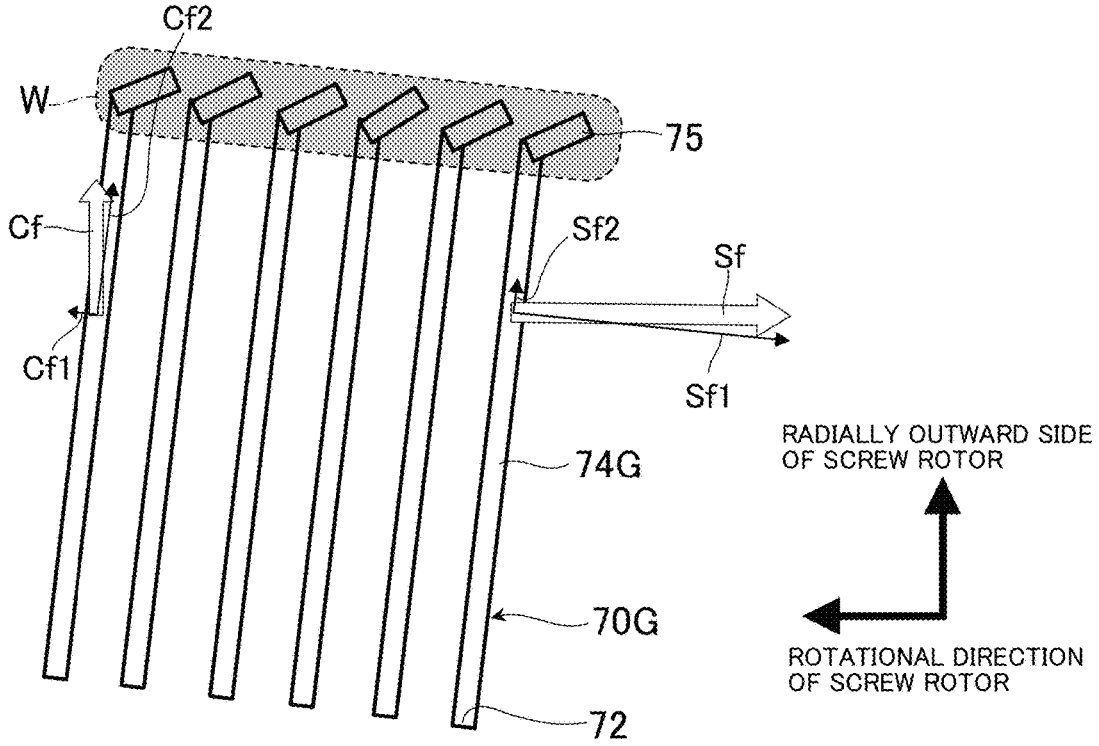
FIG. 19D is a view illustrating a fourth example of variation of the groove structures of the screw rotors of the screw compressors according to the second embodiment of the present invention and the modification thereof.

The fourth example of variation of the groove structure illustrated in FIG. 19D is generally similar to the third example of variation, but is different therefrom as to the orientation in the longitudinal directions of groove bodies 74G. Specifically, each of the groove body 74G is configured so as to be inclined at the other end (the end on the inner circumferential side) 72 of the groove body 74G as a base point with respect to the radial direction of the screw rotor in question (the male rotor 2C or the female rotor 3B) in the direction opposite to the rotational direction of the screw rotor. Unlike the groove bodies 74 according to the third example of variation, therefore, the second component forces Cf2 and Sf2 of the centrifugal force Cf and the shear force Sf act against the oil in the groove body 74G toward the outer circumferential side of the groove body 74G. The additional groove portion 75 is similar to one according to the third example of variation.

Consequently, the oil in the groove bodies 74G of the grooves 70G according to the fourth example of variation is caused to flow toward the additional groove portions 75 as the outer circumferential ends of the grooves 70G by the centrifugal force Cf and the shear force Sf, and is dammed at the additional groove portions 75, resulting in a static pressure buildup. The pressurized oil finally forms a high-pressure oil film W along the additional groove portions 75 of the grooves 70G.

Figure 19E:
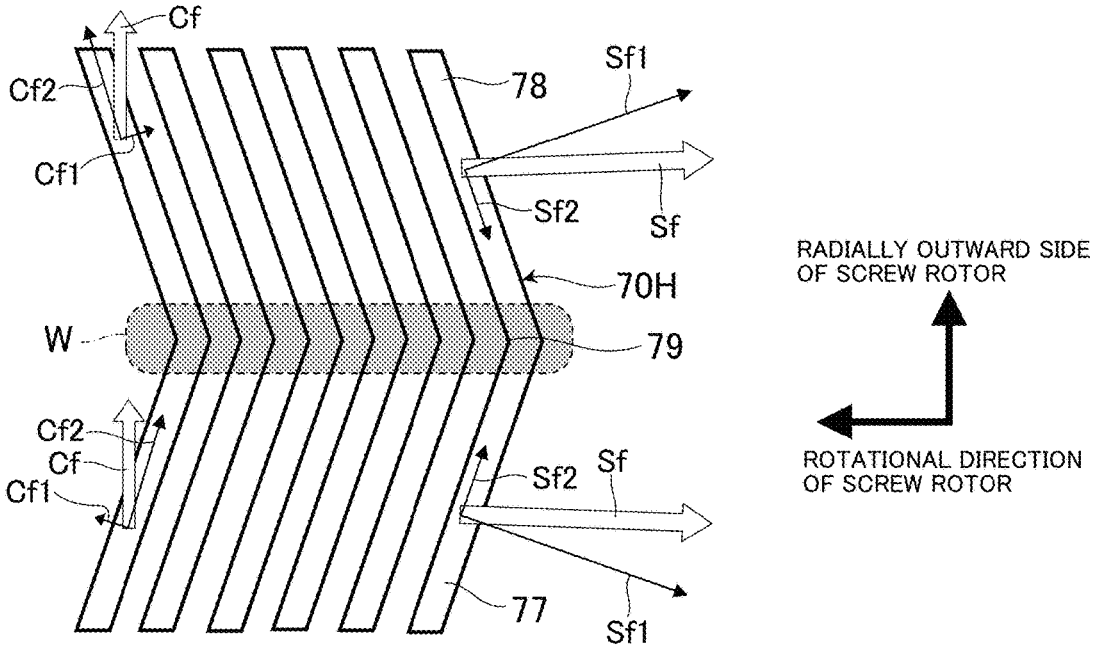
FIG. 19E is a view illustrating a fifth example of variation of the groove structures of the screw rotors of the screw compressors according to the second embodiment of the present invention and the modification thereof.

In the fifth example of variation of the groove structure illustrated in FIG. 19E, grooves 70H are each formed in a V-shape and the grooves 70H are juxtaposed in a herringbone pattern in the circumferential direction of the screw rotor in question (the male rotor 2C or the female rotor 3B). Each of the grooves 70H is formed such that the V-shape opens in the same direction as the rotational direction of the screw rotor in question.

Specifically, each of the grooves 70H includes a first groove portion 77 as one side of the V shape and a second groove portion 78 as the other side of the V shape that is positioned on the radially outward side of the screw rotor in question compared to the first groove portion 77. The first groove portion 77 is inclined with respect to the radial direction of the screw rotor in question in the opposite direction to the rotational direction of the screw rotor, whereas the second groove portion 78 is inclined with respect to the radial direction of the screw rotor in question in the same direction as the rotational direction of the screw rotor. Each of the grooves 70H is configured such that a joint 79 between the first groove portion 77 and the second groove portion 78 (a corner of the V shape) is positioned between the axial fluid communication path G2 and the working chamber Cd in the delivery process at the certain rotational position of the screw rotor in question.

As with the grooves 70, 70C according to the second embodiment and the modification thereof, the second component forces Cf2 and Sf2 of the centrifugal force Cf and the shear force Sf act against the oil in the first groove portion 77 toward the outer circumferential side. Unlike the grooves 70, 70C according to the second embodiment and the modification thereof, the second component force Sf2 of the shear force Sf acts against the oil in the second groove portion 78 toward the inner circumferential side, whereas the second component force Cf2 of the centrifugal force Cf acts against the oil in the second groove portion 78 toward the outer circumferential side. The angle of inclination of the second groove portion 78 of the groove 70H with respect to the radial direction of the screw rotor is set so as to make the second component force Sf2 of the shear force Sf larger than the second component force Cf2 of the centrifugal force Cf.

In each of the grooves 70H according to the fifth example of variation, therefore, the oil in the first groove portion 77 is caused to flow toward the joint 79 between the first groove portion 77 and the second groove portion 78 (the corner of the V-shaped groove 70H) by the centrifugal force Cf and the shear force Sf, and the oil in the second groove 78 is caused to flow toward the joint 79 by the shear force Sf. The oil flowing in the first groove portion 77 and the oil flowing in the second groove portion 78 dam each other, resulting in a static pressure buildup. The pressurized oil finally forms a high-pressure oil film W along the joints 79 (the corners) of the grooves 70H.

According to the first through fifth examples of variation of the groove structure (groove group) of the screw rotor, as described above, the oil in the grooves 70D, 70E, 70F, 70G, 70H is caused to flow by the action of at least one of the centrifugal force Cf and the shear force Sf upon rotation of the screw rotor, and is then dammed, thereby resulting in a pressure buildup of the oil. The pressurized oil then flows out into the delivery-end-face clearance G1. Therefore, as with the groove structures according to the second embodiment and the modification thereof, it is possible to form the high-pressure oil film W between the axial fluid communication path G2 and the working chamber Cd in the delivery process (high-pressure space), and restrain an internal leak via the axial fluid communication path G2.

The screw compressor according to the fifth example of variation has a feature that the grooves 70H of the groove group are each formed in a V-shape and are juxtaposed in a herringbone pattern in the circumferential direction of one rotor (the male rotor 2 or the female rotor 3), and that each of the grooves 70H of the groove group is configured such that the V-shape opens in the same direction as the rotational direction of the one rotor (the male rotor 2 or the female rotor 3).

Figure 19F:
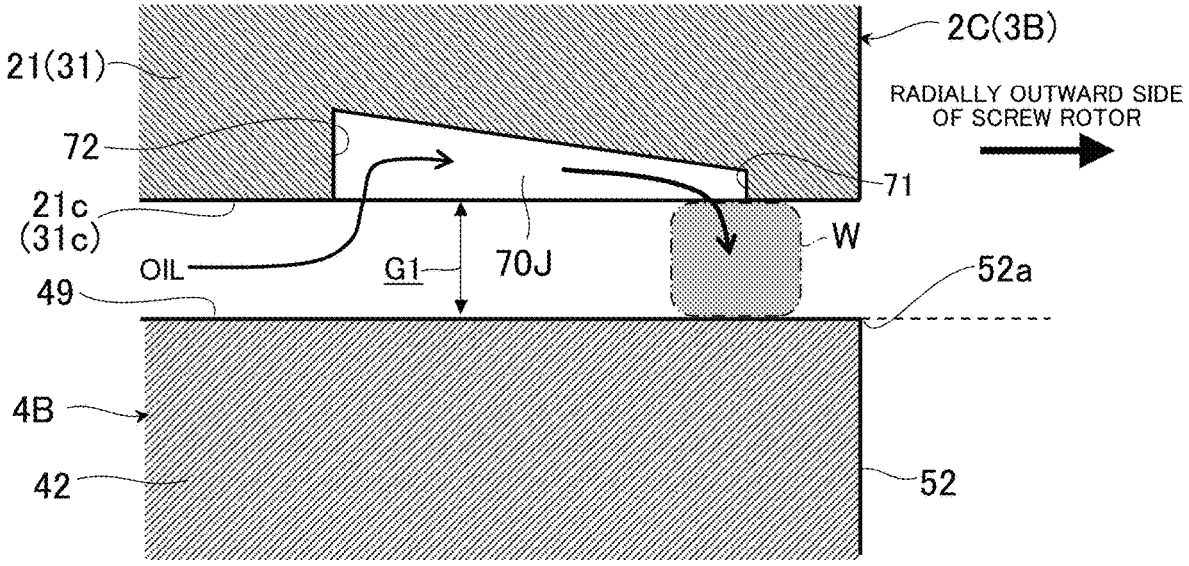
FIG. 19F is a view illustrating a sixth example of variation of the groove structures of the screw rotors of the screw compressors according to the second embodiment of the present invention and the modification thereof.

In the sixth example of variation of the groove structure illustrated in FIG. 19F, grooves 70J are each configured such that its depth is not constant, but varies in the radial direction of the screw rotor in question (the male rotor 2C or the female rotor 3B). Specifically, the groove 70J is formed such that its depth is gradually smaller from the other end 72 toward the one end 71 in the longitudinal direction thereof (from the inner circumferential side toward the outer circumferential side of the screw rotor). Namely, the groove 70J has its volume gradually smaller from the other end 72 toward the one end 71 thereof. Therefore, the volume (mass) of oil on an other-end 72 side in the groove 70J is larger than the volume (mass) of oil on an one-end 71 side in the groove 70J. Consequently, the centrifugal force acting against the oil on the other-end 72 side in the groove 70J is larger than the centrifugal force acting on the oil on the one-end 71 side in the groove 70J by as much as the mass is larger. The oil in the groove 70J dammed at the one end 71 is thus liable to flow out into the delivery-end-face clearance G1 (toward the delivery inner wall face 49 of the casing 4B).

Other Embodiments

In the above embodiments, the screw compressors 1, 1A, 1B, and 1C for compressing air have been described by way of example. However, the present invention is also applicable to screw compressors for compressing various kinds of gas, such as refrigerants of ammonia and $CO_2$. Moreover, although the oil-flooded screw compressors 1, 1A, 1B, and 1C have been described by way of example, the present invention is also applicable to screw compressors that are supplied with liquids other than oil. While oil is preferable from the standpoints of its sealing capability, the ease with which to form a liquid film, etc., it may be replaced with various kinds of liquid, e.g., water, having sufficient properties for forming a liquid film.

The groove structures according to the embodiments are applicable to liquid-free screw compressors whose working chambers are not supplied with a liquid such as oil. In the liquid-free screw compressors, compressed air rather than oil exists in the grooves formed on the delivery end faces of rotors or the delivery inner wall face of a casing.

An example of such a liquid-free screw compressor will be described below with reference to FIGS. 6 and 7. With oil being replaced with air, the shear force Sf acts on air in the grooves 60 due to friction with the delivery end face 31*c* of the female rotor 3 that faces the grooves 60 and has a speed relative to the grooves 60. The air in the grooves 60 is subjected to a force due to the shear force Sf and a reaction force from the wall faces of the grooves 60, and flows along the longitudinal directions of the grooves 60 toward the outer circumferential side of the female rotor 3. The air is then dammed at the one ends 61 of the grooves 60, and as a result, flows out into the delivery-end-face clearance G1. Therefore, in the delivery-end-face clearance G1, an area W where the pressure of air is higher than that in the peripheral region is generated in the vicinity of the one ends 61 of the grooves 60.

The amount of an internal leak of air through an end-face clearance is likely to increase as the pressure difference between a high-pressure working chamber on an upstream side and the end-face clearance on a downstream side is larger. In the presence of the grooves 60 as described above, the pressure in the delivery-end-face clearance G1 rises in the vicinity of the one ends 61 of the grooves 60. Thus, the pressure difference between the working chamber Cd in the delivery process and the delivery-end-face clearance G1 is reduced compared to a situation where the casing 4 is free of the groove 60. The groove 60 makes it possible to restrain an internal leak of air.

The present invention is not limited to the embodiments described above, but covers various modifications. The above embodiments have been described in detail for a better understanding of the present invention, and are not limited to those including all the components described above. In other words, some of the components of some of the embodiments may be replaced with some of the components of the other embodiments, and components of some of the embodiments may be added to components of the other embodiments. Furthermore, some of the components of each of the embodiments may be combined with other components added thereto, may be deleted, or may be replaced with other components.

For example, the components according to the first embodiment and the components according to the modification thereof may be combined with each other. Specifically, the groove group (groove structure) on the shield area 49*a* of the delivery inner wall face 49 of the casing may have a first groove group including the grooves 60 juxtaposed in circumferential direction of the male rotor 2 (the groove structure according to the first embodiment) and a second groove group including the grooves 60A juxtaposed in circumferential direction of the female rotor 3 (the groove structure according to the modification of the first embodiment). The grooves 60, 60A of the first groove group and the second groove group may be disposed out of physical interference with each other to obtain the advantages of both the first embodiment and the modification thereof.

Furthermore, the components according to the modification of the second embodiment may be combined with the components according to the first embodiment. Specifically, a third groove group including the grooves 70C on the delivery end face 21*c* of the male rotor 2C (the groove structure according to the modification of the second embodiment) may be provided in addition to a first groove group including the grooves 60 on the shield area 49*a* of the delivery inner wall face 49 of the casing (the groove structure according to the first embodiment). The grooves 60, 70C of the first groove group and the third groove group may be disposed out of physical interference with each other to obtain the advantages of both the first embodiment and the modification of the second embodiment.

Moreover, the components according to the second embodiment may be combined with the components according to the modification of the first embodiment. Specifically, a fourth groove group including the grooves 70 on the delivery end face 31*c* of the female rotor 3B (the groove structure according to the second embodiment) may be provided in addition to a second groove group including the grooves 60A on the shield area 49*a* of the delivery inner wall face 49 of the casing (the groove structure according to the modification of the first embodiment). The grooves 60A, 70 of the second groove group and the fourth groove group may be disposed out of physical interference with each other to obtain the advantages of both the modification of the first embodiment and the second embodiment.

In addition, the components according to the second embodiment and the components according to the modification of the second embodiment may be combined with each other. Specifically, the groove group (groove structure) on the delivery end faces of the screw rotors may have a third groove group including the grooves 70C on the delivery end face 21*c* of the male rotor 2C (the groove structure according to the modification of the second embodiment) and a fourth groove group including the grooves 70 on the delivery end face 21*c* of the female rotor 3B (the groove structure according to the second embodiment). The grooves 70, 70C of the third groove group and the fourth groove group may be disposed out of physical interference with each other to obtain the advantages according to both the second embodiment and the modification thereof.

In the embodiments described above, a casing or female and male rotors with grooves may be machined by a forming process, a cutting process, or the like. However, a casing or a rotor with grooves or both a casing and a rotor with grooves may be fabricated by a three-dimensional molding machine. Data to be used by the three-dimensional molding machine are generated by processing 3D data that have been generated by CAD or CG software or a 3D scanner into NC data according to CAM. The data thus generated are input to the three-dimensional molding machine by a desired process. Alternatively, NC data may be generated directly from 3D data according to CAD/CAM software.

DESCRIPTION OF REFERENCE CHARACTERS

1, 1A, 1B, 1C: Screw compressor
2, 2C: Male rotor
3, 3B: Female rotor
4, 4A, 4B: Casing

21*c*:Delivery end face (first delivery end face)
21*e*: Trailing flank
31*c*: Delivery end face (second delivery end face)
31*e*: Trailing flank
45: Housing chamber
49: Delivery inner wall face
49*a*: Shield area
60, 60A, 60B, 60C, 60D: Groove
64: Groove body
65: Additional groove portion
70, 70C, 70D, 70E, 70F, 70G, 70H, 70J: Groove
74, 74G: Groove body
75: Additional groove portion
G2: Axial fluid communication path
D1: Tip circle of male rotor
D2: Pitch circle of female rotor
A1: Central axis (first central axis)
A2: Central axis (second central axis)

The invention claimed is:

1. A screw compressor comprising:

a male rotor having a first delivery end face on one side in an axial direction of the male rotor;

a female rotor having a second delivery end face on one side in an axial direction of the female rotor; and a casing having a housing chamber in which the male rotor and the female rotor are rotatably housed in a mutually meshed state, wherein the casing has a delivery inner wall face that faces the first delivery end face of the male rotor and the second delivery end face of the female rotor, the delivery inner wall face of the casing has a shield area that shields at least a part of a track of an axial fluid communication path, the axial fluid communication path being a clearance that is periodically generated at the first delivery end face and the second delivery end face according to variation of an intermeshing state between the male rotor and the female rotor upon rotation thereof and that is bounded by trailing flanks of the male rotor and the female rotor, the shield area of the casing is provided with a groove group comprising a plurality of grooves having longitudinal directions, the plurality of grooves of the groove group are juxtaposed in a circumferential direction of at least one rotor of the male rotor and the female rotor, the plurality of grooves of the groove group are arranged such that their sides extending in the longitudinal directions are disposed adjacent to each other, and each of the plurality of grooves of the groove group is configured such that its longitudinal direction oriented from an inner circumferential side of the one rotor toward an outer circumferential side is inclined with respect to a radial direction of the one rotor in a same direction as a rotational direction of the one rotor.

2. The screw compressor according to claim 1, wherein the groove group includes:

a first groove group comprising a plurality of grooves juxtaposed in a circumferential direction of the male rotor; and a second groove group comprising a plurality of grooves juxtaposed in a circumferential direction of the female rotor.

3. The screw compressor according to claim 1, wherein, the first delivery end face of the male rotor is provided with a third groove group comprising a plurality of grooves having longitudinal directions in a case where the one rotor is the female rotor, the plurality of grooves of the third groove group are juxtaposed in a circumferential direction of the male rotor, and the plurality of grooves of the third groove group are arranged such that their sides extending in the longitudinal directions are disposed adjacent to each other.

4. The screw compressor according to claim 1, wherein, the second delivery end face of the female rotor is provided with a fourth groove group comprising a plurality of grooves having longitudinal directions in a case where the one rotor is the male rotor, the plurality of grooves of the fourth groove group are juxtaposed in a circumferential direction of the female rotor, and the plurality of grooves of the fourth groove group are arranged such that their sides extending in the longitudinal directions are disposed adjacent to each other.

5. The screw compressor according to claim 1, wherein each of the plurality of grooves of the groove group has, in combination, a groove body having the longitudinal direction and an additional groove portion connected to the groove body, the additional groove portion being different in shape from the groove body, and the groove body is configured such that its longitudinal direction oriented from the inner circumferential side of the one rotor toward the outer circumferential side is inclined with respect to the radial direction of the one rotor in the same direction as the rotational direction of the one rotor.

6. The screw compressor according to claim 1, wherein each of the plurality of grooves of the groove group is curved.

7. The screw compressor according to claim 1, wherein each of the plurality of grooves of the groove group has a depth in a range of equal to or greater than 1 μm and equal to or smaller than 1 mm.

8. A screw compressor comprising:

a male rotor having a first delivery end face on one side in an axial direction of the male rotor and rotatable about a first central axis;

a female rotor having a second delivery end face on one side in an axial direction of the female rotor and rotatable about a second central axis; and a casing having a housing chamber in which the male rotor and the female rotor are rotatably housed in a mutually meshed state, wherein the delivery end face of at least one rotor of the male rotor and the female rotor is provided with a groove group comprising a plurality of grooves having longitudinal directions, the plurality of grooves of the groove group are juxtaposed in a circumferential direction of the one rotor, the plurality of grooves of the groove group are arranged such that their sides extending in the longitudinal directions are disposed adjacent to each other, and each of the plurality of grooves of the groove group has, in combination, a groove body having a longitudinal direction and an additional groove portion connected to the groove body, the additional groove portion being different in shape from the groove body.

9. The screw compressor according to claim 8, wherein each of the plurality of grooves of the groove group is configured such that its longitudinal direction oriented from an inner circumferential side of the one rotor toward an outer circumferential side is inclined with respect to a radial direction of the one rotor in a direction opposite to a rotational direction of the one rotor.

10. The screw compressor according to claim 8, wherein the groove body is configured such that its longitudinal direction extends along a radial direction of the one rotor or such that its longitudinal direction oriented from an inner circumferential side of the one rotor toward an outer circumferential side is inclined with respect to the radial direction of the one rotor in a direction opposite to a rotational direction of the one rotor.

11. The screw compressor according to claim 8, wherein each of the plurality of grooves of the groove group is configured such that its depth in the longitudinal direction decreases from an inner circumferential side toward an outer circumferential side of the one rotor.

12. A screw compressor comprising:

a male rotor having a first delivery end face on one side in an axial direction of the male rotor and rotatable about a first central axis;

a female rotor having a second delivery end face on one side in an axial direction of the female rotor and rotatable about a second central axis; and a casing having a housing chamber in which the male rotor and the female rotor are rotatably housed in a mutually meshed state, wherein the delivery end face of at least one rotor of the male rotor and the female rotor is provided with a groove group comprising a plurality of grooves having longitudinal directions, the plurality of grooves of the groove group are juxtaposed in a circumferential direction of the one rotor, the plurality of grooves of the groove group are arranged such that their sides extending in the longitudinal directions are disposed adjacent to each other, each of the plurality of grooves of the groove group is configured such that its depth in the longitudinal direction gradually decreases from an inner circumferential side toward an outer circumferential side of the one rotor, and the end of the outer peripheral side of the one rotor in the longitudinal direction becomes a wall surface that can dam a flow of fluid.

13. The screw compressor according to claim 12, wherein the plurality of grooves of the groove group are disposed within a range of a distance of ($a_1+a_2-b$) from a pitch circle of the female rotor toward the second central axis in a case where the one rotor is the female rotor, and the plurality of grooves of the groove group are disposed within a range of the distance of ($a_1+a_2-b$) from a tip circle of the male rotor toward the first central axis in a case where the one rotor is the male rotor, where a distance from the first central axis of the male rotor to the tip circle of the male rotor is $a_1$, a distance from the second central axis of the female rotor to the pitch circle of the female rotor is $a_2$, and a distance between the first central axis and the second central axis is b.

14. The screw compressor according to claim 12, wherein the groove group includes:

a third groove group comprising a plurality of grooves that are provided on the first delivery end face of the male rotor; and a fourth groove group comprising a plurality of grooves that are provided on the second delivery end face of the female rotor.

15. The screw compressor according to claim 12, wherein each of the plurality of grooves of the groove group is curved.

16. The screw compressor according to claim 12, wherein each of the plurality of grooves of the groove group has a depth in a range of equal to or greater than 1 μm and equal to or smaller than 1 mm.

* * * * *